US005430532A

United States Patent [19]

Ueda et al.

[11] Patent Number: 5,430,532

[45] Date of Patent: Jul. 4, 1995

[54] DEVELOPING DEVICE WITH A TILT DETECTING FUNCTION DESIGNED FOR A TRICKLE SYSTEM

[75] Inventors: Atsushi Ueda, Shiki; Yasuhiro Takai, Sakurai; Hirokazu Tanaka, Osaka; Hideo Yamasa, Yamatokoriyama; Kouichi Irihara, Nara, all of Japan

[73] Assignee: Sharp Kabushiki Kaisha, Osaka, Japan

[21] Appl. No.: 207,294

[22] Filed: Mar. 7, 1994

[30] Foreign Application Priority Data

Mar. 9, 1993 [JP] Japan ..... 5-047897
Jun. 8, 1993 [JP] Japan ..... 5-137609

[51] Int. Cl.[6] ..... G03G 15/08

[52] U.S. Cl. ..... 355/260; 355/245; 355/209

[58] Field of Search ..... 355/260, 245, 253, 259; 118/653, 656–658

[56] References Cited

U.S. PATENT DOCUMENTS 4,629,309 12/1986 Tsukano et al. .
4,891,673 1/1990 Buell ..... 355/245
5,095,338 3/1992 Hayes, Jr. et al. ..... 355/246
5,235,391 8/1993 Aimoto ..... 355/245 X
5,237,373 8/1993 Aimoto et al. ..... 355/245 X

OTHER PUBLICATIONS

English Translation of a Portion of Japanese Document 2-21591, Published May 1990.

*Primary Examiner*—R. L. Moses
*Attorney, Agent, or Firm*—David G. Conlin; Peter F. Corless

[57] ABSTRACT

A developing device is provided with a developer vessel for storing therein a developer material composed of toner particles and carrier granules and a developer material supply section for gradually supplying a carrier developer including the carrier granules from above the developer vessel, wherein a discharge opening for discharging therethrough the developer material is formed on a side face of the developer vessel. When a tilt detection unit provided with the developing device detects the tilt of the developing device, an alarm lamp is set ON for sending a warning. In the meantime, the discharge opening is closed for preventing an excessive overflow of the developer material from the developer vessel.

20 Claims, 24 Drawing Sheets

DEVELOPING DEVICE WITH A TILT DETECTING FUNCTION DESIGNED FOR A TRICKLE SYSTEM

BACKGROUND OF THE INVENTION

1. Field of the Invention

The present invention relates to a developing device for storing therein a developer material composed of toner particles and carrier granules. The device supplies the developer material onto a surface of a photoreceptor in order to visualize an electrostatic latent image formed on the surface of the photoreceptor provided in an electrophotographic printing machine such as a copying machine.

2. Description of the Prior Art

Developer devices for visualizing ( developing ) an electrostatic latent image formed on the surface of a photoreceptor using a developer material composed of carrier granules and toner particles are used, for example, in many dry-type copying machines. In such developing devices, the quantity of the toner particles is reduced while being used in the developing process; whereas, the quantity of carrier granules in the developer material remains the same. Therefore, the quality of the carrier granules being stirred with toner particles in the developer vessel deteriorates because a resin coating layer on the surface thereof is peeled, or toner particles adhere onto the surface thereof. As a result, the charging ability of the developer material gradually deteriorates, thereby presenting the problem that the copied image quality deteriorates.

A device designed for the trickle system which prevents the deterioration of the charging ability by supplying additional carrier granules separately from the refill for the used toner particles is disclosed (see, for example, Japanese Laid-Open Patent Application No. 21591/1990 (Tokukouhei 2-21591)). In such a device, when adding additional carrier granules, excessive developer material in the developer vessel overflows and is discharged through a discharge opening formed on the side face of the developer vessel to be collected in a collecting case. By repeating the above refill and discharge of the developer material, the developer material in the developer vessel whose charging ability has deteriorated can gradually replace. Thus, the required charging ability of the developer material can be maintained, and the copied image quality is prevented from being lowered.

However, in the above developing device, the developer material in the developer vessel overflows and is discharged through the discharge opening provided on the side face of the developer vessel. Thus, depending on the tilt of the developing device, a quantity of the developer material to be discharged through the discharge opening changes. For example, when moving the copying machine, as being tilted, a large quantity of the developer material may be discharged through the discharge opening at one time, or an appropriate quantity of the developer material in the developer vessel may not be discharged. If this occurs, there arises a great difference from appropriate quantity of the developer material in the developer vessel, thereby presenting the problem that the copied image quality is lowered.

More specifically, when moving the copying machine, if the copying machine is tilted in the direction where the discharge opening is placed at lower position than the reference position, a large quantity of the developer material is discharged through the discharge opening, and the quantity of the developer material in the developer vessel becomes much less than the appropriate quantity. The above situation may occur even after the copying machine is moved if the developing device is being used in the above tilted position.

If the above situation occurs, the charging ability of the developer material deteriorates, thereby presenting the problem that the copied image quality is lowered. Moreover, in the case of controlling the ratio of the toner particles to the carrier granules by the output from a permeability sensor, the ratio of the toner particles cannot be detected accurately due to a reduced quantity of carrier granules in contact with the permeability sensor, thereby presenting the problems that the ratio of the toner particle drops and the image density is reduced. Furthermore, if the quantity of the developer material in the developer vessel is greatly reduced, a magnetic brush may not be formed, and therefore the developing process may not be carried out desirably. Moreover, the image may be blurred, or the image may not be developed. Furthermore, even after the tilt of the developing device is set back to the horizontal position, an appropriate quantity of the developer material cannot be achieved immediately, and thus a desirable quality of the copied image cannot be ensured for a while.

On the other hand, if the developing device is being used in the tilted position in the direction where the discharge opening is placed at upper position than the reference position after the copying machine is moved, the developer material is not discharged through the discharge opening, and thus an excessive quantity of the developer material exists in the developer vessel.

If this occurs, the drive torque for driving a developer material supply section provided in the developer vessel increases, and the developing device may not be activated properly, thereby presenting the problem that the developer material may not be supplied onto the photoreceptor surface appropriately. Furthermore, in the case of controlling the ratio of the toner particles to the carrier granules by the output from the permeability sensor, the quantity of the developer material becomes excessive with respect to the appropriate quantity, thereby presenting the problem that the copied image quality is lowered.

Namely, in the arrangement where the developer material overflows and is discharged through the discharge opening, if the developing device is tilted, an appropriate discharge of the developer material through the discharge opening may not be ensured, and thus the developer material may not be supplied onto the photoreceptor surface appropriately, thereby presenting the problem that the copied image quality deteriorates.

SUMMARY OF THE INVENTION

An objective of the present invention is to provide a developing device with a tilt detection function which sends out a warning to the user when the tilt of the developing device is detected.

Another objective of the present invention is to provide a developing device which permits a developer material in a developer vessel to be maintained in an appropriate quantity by preventing a change in the quantity of the developer material in the developer vessel due to a tilt of the developer vessel, thereby ensuring a desirable copied image quality.

In order to achieve the above objective, the developing device of the present invention designed for a trickle system is provided with a developer vessel for storing therein a developer material composed of toner particles and carrier granules and a developer material supply section for supplying a carrier developer including the carrier granules from above the developer vessel. In the developer vessel, stirring means for stirring the developer material and a developer roller for supplying the developer material to a photoreceptor are respectively provided so as to be freely rotatable. On the side face of the developer vessel, a discharge opening for discharging therethrough the developer material is formed. The developing device is characterized by comprising tilt detection means for detecting a tilt of the developer vessel and warning means for sending out a warning when the tilt detection means detects that the developer vessel is tilted over a predetermined level.

The developing device of the present invention is further provided with an opening and closing plate on an inner surface of the side face of the developer vessel and includes control means which activates the warning means and closes the opening and closing plate when the tilt of the developing device is detected.

According to the above arrangement, when the tilt detection means detects that the developer vessel is tilted over the predetermined level, the warning means sends out a warning. In this way, since the tilt of the developer vessel can be accurately detected, the user can quickly set the tilted developer vessel back to the horizontal position. As a result, the developer material can be supplied onto the photoreceptor as desired, thereby preventing the problem that the quality of the image formed on a document deteriorates.

In the above arrangement, when the developer vessel is tilted over the predetermined level, as the opening and closing plate is closed, the discharge of the developer material through the discharge opening can be prevented. In the meantime, the tilted developer vessel can be set back to the horizontal position based on the warning sent out from the warning means. Therefore, both of the following cases can be prevented: when the developer vessel is tilted over the predetermined level in the direction where the discharge opening is placed at relatively lower position, the developer material in the developer vessel is greatly reduced as a result of discharging a large quantity of the developer material from the developer vessel; and when the developer vessel is tilted over the predetermined level in the direction where the discharge opening is placed at relatively upper position, the quantity of the developer material in the developer vessel is greatly increased. As a result, the deterioration in the copied image quality due to a great change of the developer material from an appropriate quantity in the developer vessel can be prevented.

The developing device of the present invention is arranged such that the opening and closing plate is provided on an inner surface of the side face of the developer vessel so that it can be freely moved to or away from the discharge opening. The opening and closing plate is normally held open by pressing means. However, when the developer vessel is tilted, the opening and closing plate is moved so as to close the discharge opening by the weight of the developer material exerted thereon as the developer material moves onto the discharge opening.

In this arrangement, even if the discharge opening is placed at relatively lower position over the predetermined level as the the developer vessel is tilted, the developer material in the developer vessel is not reduced excessively by being discharged, thereby preventing the problem that the copied image quality deteriorates due to a great change in the quantity of the developer material in the developer vessel from the appropriate quantity.

BRIEF DESCRIPTION OF THE DRAWINGS

FIG. 18(*b*) is a view taken of line I—I of FIG. 18(*a*).

FIG. 19(*b*) is a cross-sectional view taken on line K—K of FIG. 19(*a*).

DETAILED DESCRIPTION OF THE PREFERRED EMBODIMENTS

The following description will discuss one embodiment of the present invention in reference to FIG. 1 through FIG. 6.

Figure 2:
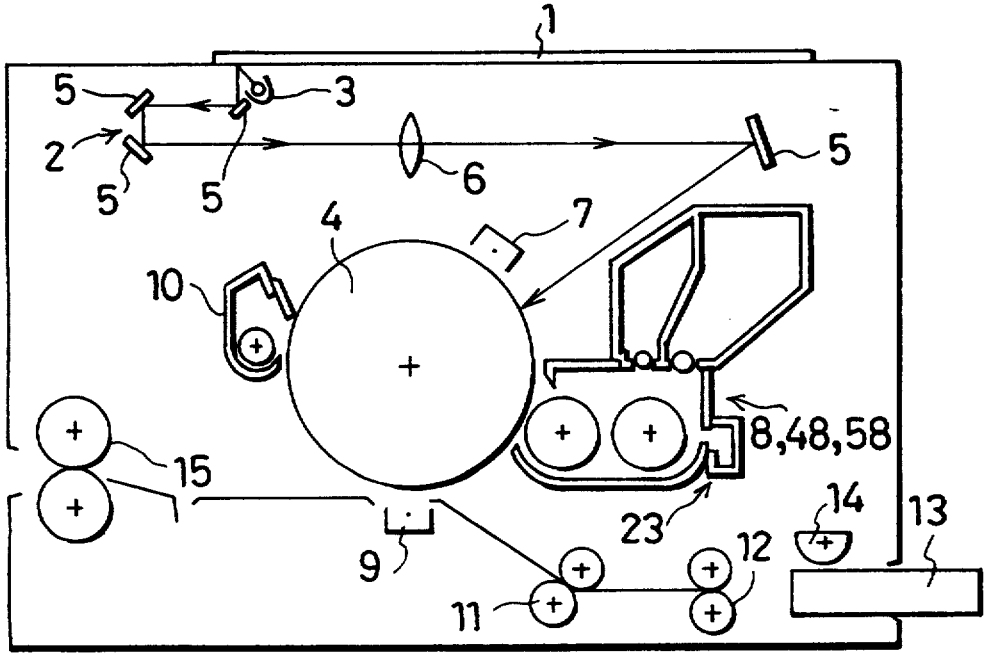
FIG. 2 is an explanatory view which shows an entire configuration of a copying machine provided with the developing device of FIG. 1.

As shown in FIG. 2, a copying machine designed for the present invention is provided with a document platen 1 on an upper portion and an exposure-use optical system 2 placed under the document platen 1. The exposure-use optical system 2 is composed of an optical source lamp 3 which projects light so as to scan the document (not shown) placed on the document platen 1, a plurality of reflecting mirrors 5 for directing a reflected light from the document to a photoreceptor 4 and a lens unit 6 placed along a light path of the reflected light.

Along the circumference of the photoreceptor 4, the following units are provided: a charger 7 for charging the surface thereof to a predetermined potential; an eraser (not shown); a developing device 8 for developing an electrostatic latent image formed on the surface of the photoreceptor 4; a transfer charger 9 for transferring a toner image formed on the surface of the photoreceptor 4 to a sheet; a cleaning unit 10 for collecting toner particles remaining on the surface of the photoreceptor 4; and a charge remover (not shown). On the sheet entry side of the photoreceptor 4, a timing roller 11 for feeding sheets at a predetermined timing, a transport roller 12, a feed cassette 13 and a feed roller 14 are provided. On the sheet discharge side of the photoreceptor 4, a fuser 15 is provided for making a toner image transferred onto a sheet permanently affixed thereto.

Figure 1:
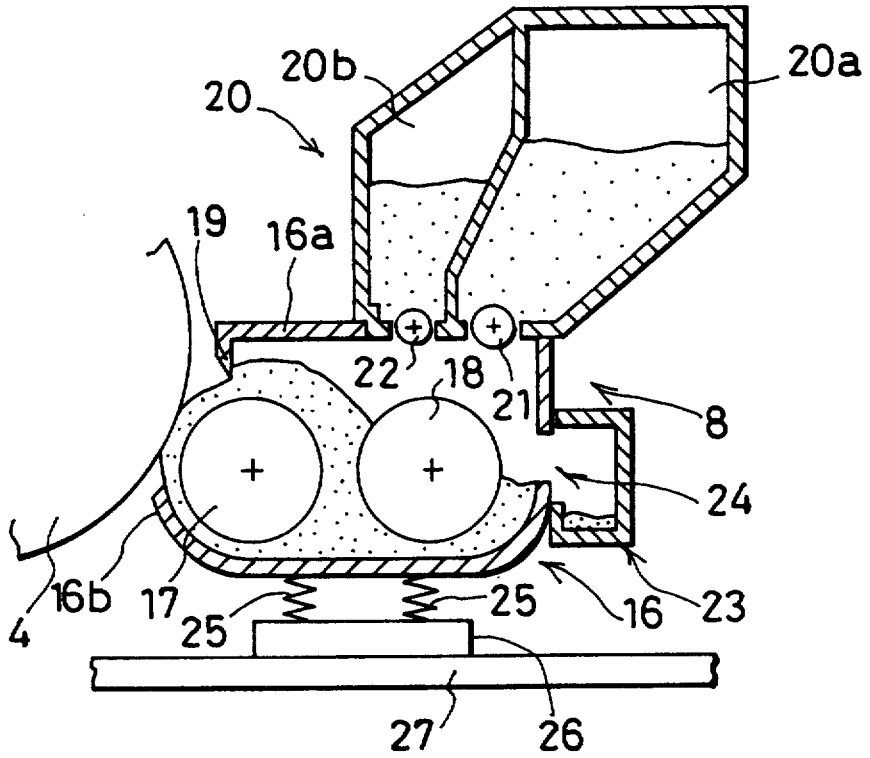
FIG. 1 is a longitudinal sectional view of a developing device in accordance with one embodiment of the present invention.

As shown in FIG. 1, the developing device 8 includes an enclosed developer vessel 16. Further, a developer roller 17 composed of a magnet roller and a stirring roller 18 (stirring means) are provided in the developer vessel 16 so as to be freely rotatable. The developer material stored in the developer vessel 16 is composed of carrier granules and toner particles. A carrier granule made of a magnetic substance includes a resin coating layer formed on the surface thereof for controlling the adherence of toner particles. While carrier granules and toner particles are being mixed by the stirring roller 18, the toner particles are electrically charged by friction. The developer roller 17 attracts carrier granules by a magnetic force and carries them forming a magnetic brush. Thus, the toner particles adhering onto carrier granules by Coulomb force are attached onto the electrostatic latent image formed on the photoreceptor 4, thereby developing the electrostatic latent image. Here, the length of the magnetic brush is controlled by a doctor 19.

Further, an entry opening for supplying therethrough additional developer material is formed at a ceiling 16*a* of the developer vessel 16. A developer material feed unit 20 (developer material supply section) is set from above the entry opening so as to fit thereto. The developer material feed unit 20 is divided into two compartments: a toner particle storing compartment 20*a* and a carrier developer storing compartment 20*b*. In the toner particle storing compartment 20*a*, toner particles are stored, and in the carrier developer storing compartment 20*b*, a developer material composed only of carrier granules (hereinafter referred to as a carrier developer) or a developer material composed of toner particles and carrier granules in a predetermined ratio is stored.

On the respective bottoms of storing compartments 20*a* and 20*b*, a toner supply roller 21 and a carrier developer supply roller 22 are provided. By the rotations of the toner supply roller 21, the toner particles in the toner particle storing compartment 20*a* drop into the developer vessel 16 according to the driving time of the toner supply roller 21. Similarly, by the rotations of the carrier developer supply roller 22, the carrier granules in the carrier developer storing compartment 20*b* drop into the developer vessel 16 according to the driving time of the carrier developer supply roller 22.

On the side face 16*b* of the developer vessel 16, an enclosed collecting case 23 (developer material collecting means) with an opening on the side thereof is provided so as to be in contact therewith. The collecting case 23 is provided for collecting the developer material discharged from the developer vessel 16. The collecting case 23 is provided so that it can freely slides along the developer vessel 16. The collecting case 23 is detachable from the frame of the copying machine (not shown). In the above arrangement, in measuring the weight of the developing device 8 by a device weight measuring plate 26, the weight of the developing device excluding the weight of the collecting case 23 can be measured.

Under the side face 16*b* of the developer vessel 16, a plurality of springs 25 are provided on the lower frame 27 side of the copying machine. The leading end of the springs 25 are connected to the device weight measuring plate 26 for measuring the weight of the developing device 8 provided on the lower frame 27 of the copying machine. As described above, the weight of the developing device 8 excluding the collecting case 23 can be measured.

Figure 3:
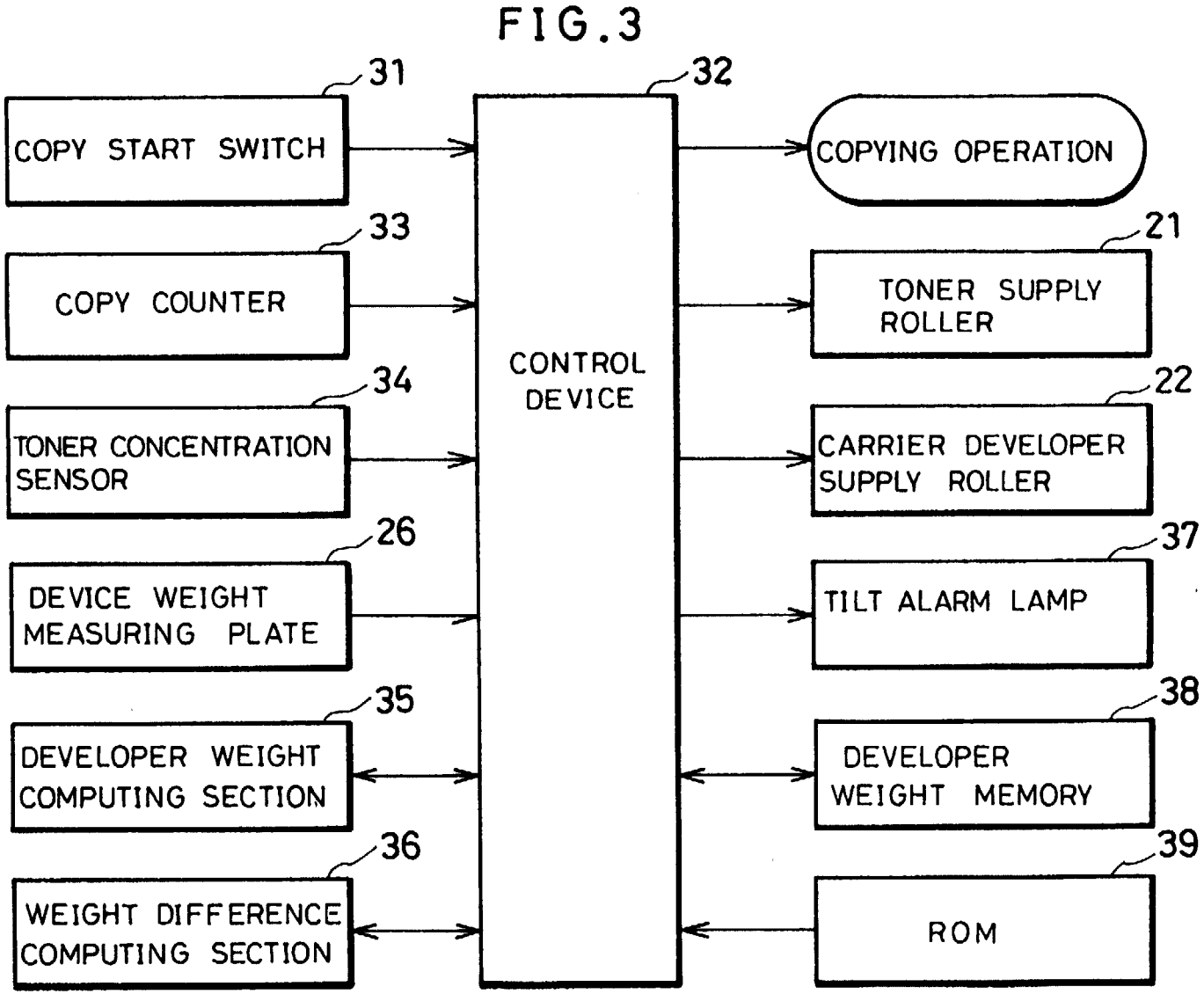
FIG. 3 is a block diagram of a control device in the copying machine of FIG. 2.

As shown in FIG. 3, the device weight measuring plate 26 is connected to the control device 32 composed of a microcomputer. The control device 32 is connected to a developer weight computing section 35 (developer material weight computing means) and the developer weight memory 38 (developer material weight memory means). The developer weight computing section 35 is provided for computing the weight of the developer material in the developer vessel 16. The developer weight memory 38 is provided for storing therein the weight of the developer material computed in the developer weight computing section 35. The control device 32 is also connected to ROM 39 which stores therein various data such as the tare weight of the developer vessel 16, the tare weight of the developer material supply unit 20, etc.

In the developer computing section 35, the weight of the developer material in the developer vessel 16 is computed based on the following equation:

Weight of the Developing Device − Tare Weight of the Developer Vessel − Tare Weight of the Developer Material Supply Unit − Weight of the Toner Particles = Weight of the Developer Material in the Developer Vessel.

Here, the weight of the toner particles is defined as the weight of the toner particles remaining in the developer material supply unit 20. Since the quantity is always equal to the quantity of toner particles to be supplied per one rotation of the toner supply roller 21, it can be measured from the number of rotations of the toner supply roller 21. The weight of the developing device is measured by the device weight measuring plate 26. The tare weight of the developer vessel and the tare weight of the developer material supply unit are stored in the ROM 39 beforehand.

As a note, the tare weight of the developer vessel and the tare weight of the developer material supply unit differ depending on the type of the electrophotographic printing machine such as a copying machine or even within the electrophotographic printing machines of the same type. Thus, the value for each machine is stored in the ROM 39.

The control device 32 is connected to a weight difference computing section 36 (weight difference computing means) which computes a difference between the weight of the developer material stored in the developer vessel 16 computed by the developer weight computing section 35 and the weight of the developer material stored in the developer vessel 16 which is most currently stored in the developer weight memory 38. The control device 32 detects a change in the quantity of the developer material in the developer vessel 16 by computing the difference.

The weight difference computing section 36 subtracts the currently stored weight of the developer material from the previously stored weight of the developer material.

When the developer vessel 16 is maintained horizontal, the same quantity of the developer material as the discharged developer material is supplied so as to maintain the developer material in the developer vessel 16 in the same quantity. Thus, from the difference in the weight of the developer material in the developer vessel 16, a change in the weight of the developer material discharged from the developer vessel 16 can be detected, and from this change in the weight, the tilted state of the developing device 8 can be derived.

For example, when the above difference shows a negative value, i.e., when the computed quantity of the developer material in the developer vessel 16 is larger than the most currently stored quantity of the developer material, an appropriate quantity of the developer material is not discharged from the developer vessel 16. Namely, the discharge opening 24 is placed at relatively upper position, thereby detecting the tilt of the developing device 8. On the other hand, when the above difference shows a positive value, i.e., when the computed quantity of the developer material in the developer vessel 16 is smaller than the most currently stored quantity of the developer material, an excessive amount of the developer material is discharged from the developer vessel 16. Namely, the discharge opening 24 is placed at relatively lower position, thereby detecting the tilt of the developing device 8.

Figure 4:
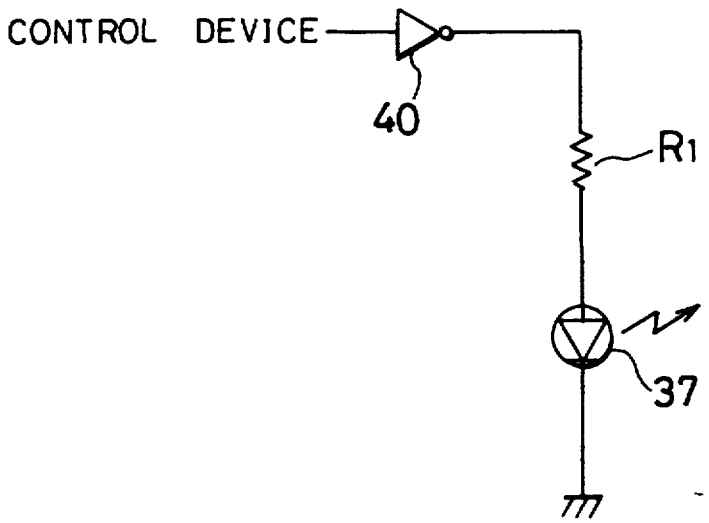
FIG. 4 is a drive circuit diagram of a tilt alarm lamp shown in FIG. 3.

The control device 32 is also connected to the tilt alarm lamp 37 composed of a light emitting diode which serves as alarm means for sending out an alarm signal indicative of the tilt of the developing device 8. As shown in FIG. 4, in the drive circuit of the tilt alarm lamp 37, a signal outputted from the control device 32 is inputted to the tilt alarm lamp 37 via an inverter 40 and a resist $R_1$. When the difference exceeds a predetermined level, the control device 32 outputs a signal of Low level. On the other hand, when the difference does not exceed the predetermined level, the control device 32 outputs a signal of High level. More concretely, when the difference exceeds the predetermined level, the signal of Low level outputted from the control device 32 is inputted into the tilt alarm lamp 37 after passing through the inverter 40 and the resist $R_1$, thereby lightening the tilt alarm lamp 37. On the other hand, when the difference does not exceed the predetermined level, the signal of High level outputted from the control device 32 is inputted into the tilt alarm lamp 37 through the inverter 40 and the resist $R_1$, thereby lighting off the tilt alarm lamp 37.

Here, the tilt alarm lamp 37 is provided on a operation panel (not shown) so that it can be easily seen by the user. However, it may be also arranged such that when the tilt alarm lamp 37 is lightened, it gives a sound.

A copying operation in the copying machine having the above arrangement will be explained below.

When a power switch (not shown) is turned ON, the warming up process is carried out. When a copy start switch 31 (to be described later) is turned ON after the warming-up process is completed, a light source lamp 3 in the exposure-use optical system 2 scans a document placed on the document platen 1. In this state, a reflected light from the document is projected onto the photoreceptor 4 through the reflecting mirror 5 and the lens unit 6, thereby forming an electrostatic latent image on the photoreceptor 4 which is charged in a predetermined potential by the charger 7. Next, the electrostatic latent image is developed using toner particles supplied from the developing device 8. A toner image thus formed on the surface of the photoreceptor 4 is copied onto a sheet supplied from the feed cassette 13 by the transfer charger 9, and is made permanent on the sheet by the fuser 15. As a result, a copied image corresponding to the image on the document is formed on the sheet.

In order to control this sequential copying process, the control device 32 shown in FIG. 3 is provided in the copying machine. An ON-operation signal from the copy start switch 31 is inputted into the control device 32. The control device 32 stores therein a copy counter 33 for counting an accumulated number of copying operations, and this count value n (hereinafter referred to as a copy count value) is also inputted into the control device 32.

When the copying operation is repeated, toner particles in the developer material stored in the developer vessel 16 of the developing device 8 is gradually consumed, thereby reducing the ratio of the toner particles to the carrier granules, i.e., reducing the concentration of the toner particles. In order to detect a change in the concentration of the toner particles, a toner concentration sensor 34 is provided in the developer vessel 16. The control device 32 also controls the driving of the toner supply roller 21 based on a signal from the toner concentration sensor 34. More concretely, when the toner concentration sensor 34 detects by a detection signal that the toner concentration is lowered to the lower limit of the range appropriate for developing, the toner supply roller 21 starts activating. As a result, toner particles in the toner storing compartment 20*a* is supplied into the developer vessel 16, thereby raising the toner concentration in the developer vessel 16. When the toner concentration sensor 34 detects by the detection signal that the toner concentration reaches the upper limit of the appropriate range for developing, the toner supply roller 21 stops activating.

By being thus controlled, the toner concentration in the developer vessel 16 is maintained within the appropriate range.

The toner particles thus supplied are mixed with the developer material originally stored in the developer vessel 16 by stirring, and after controlling it to have a predetermined charge quantity, it is supplied onto the photoreceptor 4 to be used in developing. On the other hand, the quantity of the carrier granules in the developer material remain the same, and thus they are used repeatedly. Therefore, as being stirred by the developer roller 17 and the stirring roller 18 and by being in contact with the photoreceptor 4, the charging ability of the carrier granules gradually deteriorate. As the carrier granules deteriorate, it is difficult to charge toner particles in a predetermined charge quantity, thereby presenting the problem that a quality of the copied image is lowered. The above problem can be prevented by also supplying the carrier granules into the developer vessel 16 so as to replace the carrier granules whose charging ability has deteriorated. In this arrangement, the control device 32 is also required to control the supply of the carrier developer from the carrier developer storing compartment 20*b* and the supply and discharge of the developer material in or from the developer vessel 16.

Figure 5:
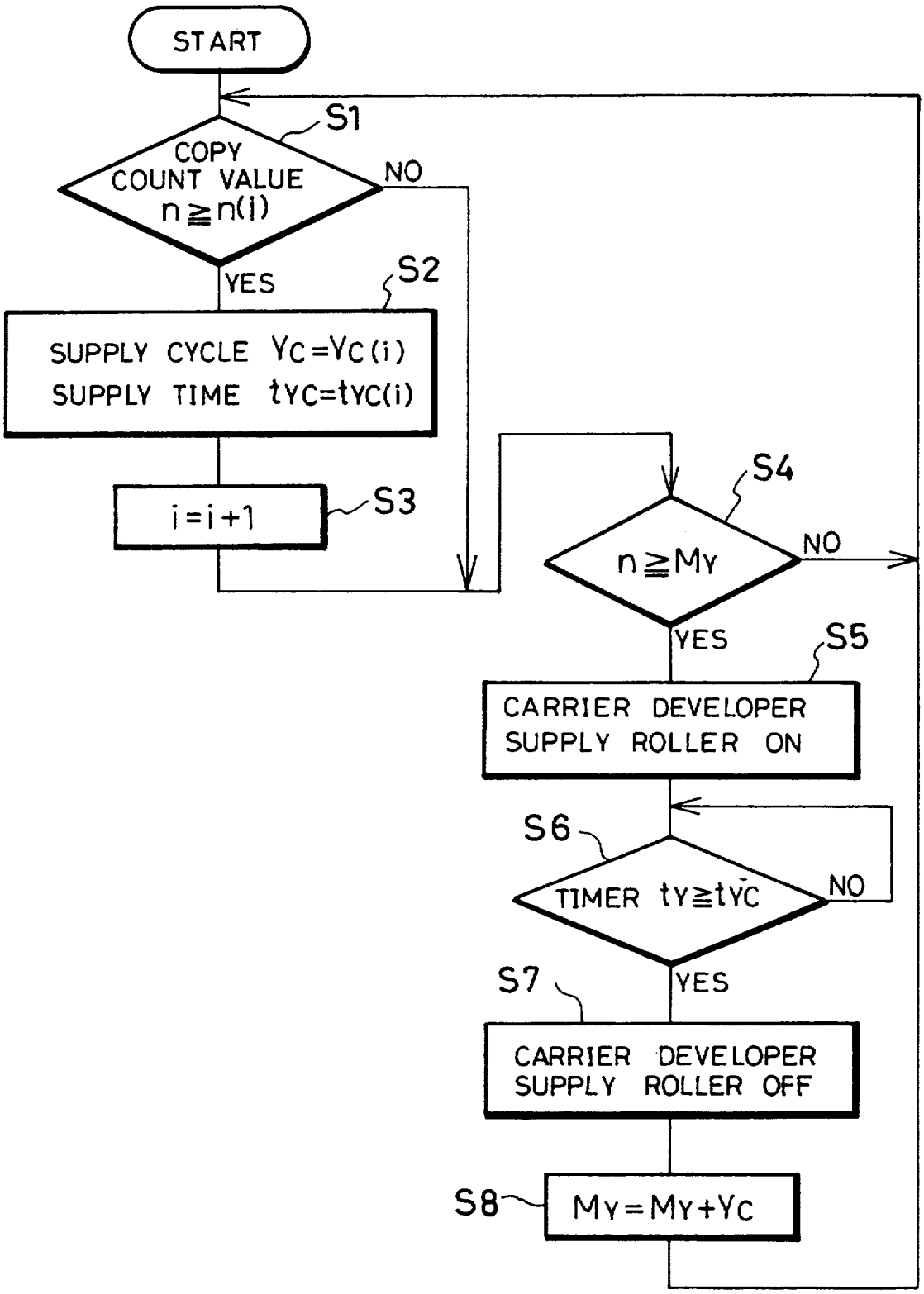
FIG. 5 is a flow chart showing the process for the supply control of a carrier developer in a control device of the copying machine.

The processes for controlling the supply and discharge of the developer material will be explained below with reference to FIG. 5.

First, a copy count value n in the copy counter 33 is compared with a switching count value n(i) every time the copying process is executed (S1).

The respective values for a supply cycle $Y_C$ and a supply time $T_{YC}$ are changed according to n(i) set beforehand. A plurality of values corresponding to n(1), n(2), . . . are stored in a memory in the control device 32, and these stored values are read out in response to a parameter i in S1. In the memory, the supply cycle value $Y_C$ (i) and supply time $t_{YC}$(i) are stored corresponding to each switching count value n(i) (i=1,2, . . . ).

In S1, when it is determined that the copy count value n reaches a switching count value n(i), $Y_C$(i) and $t_{YC}$(i) respectively corresponding to n(i) at this time are set as supply cycle $Y_C$ and the supply time $t_{YC}$ to replace old values (S2). Thereafter, the parameter i increases by 1 (S3).

After carrying out the above processes S1–S3 for renewing the values, the copy count value n is compared with a supply timing value $M_y$ (S4). If n has not reached $M_y$, the sequence goes back to S1. On the other hand, if n has reached $M_y$, the carrier developer supply roller 22 is set ON (S5). As a result, the supply of carrier developer is started from the carrier developer storing compartment 20*b* to the developer vessel 16. Simultaneously, the timer for watching the supply time starts counting (S6). When the time elapsed $t_y$ counted by the timer reaches the supply time $t_{YC}$, the supply of additional carrier developer is stopped by turning OFF the carrier developer supply roller 22 (S7). Then, the supply cycle $Y_C$ is added to the supply timing value $M_y$ (S8), and the sequence goes back to S1. As a result, the supply timing value $M_y$ becomes an accumulated number of copies update to be supplied next.

By repeating the above control, whenever a copying process is carried out $Y_C$ times, the carrier developer supply roller 22 is driven for a predetermined time $t_{YC}$, and additional carrier developer is supplied to the developer vessel 16 according to the driving time of the carrier developer supply roller 22.

When additional carrier developer is supplied to the developer vessel 16, the quantity of developer material gradually increases. However, because the discharge opening 24 is provided, an excessive developer material which overflows is removed out of the developer vessel 16 and is collected in the collecting case 23. As described, by repeating the supply of additional carrier developer and the discharge of excessive developer material to and from the developer vessel 16, excessive developer material in the developer vessel 16 can replace before the quality thereof deteriorates.

Figure 6:
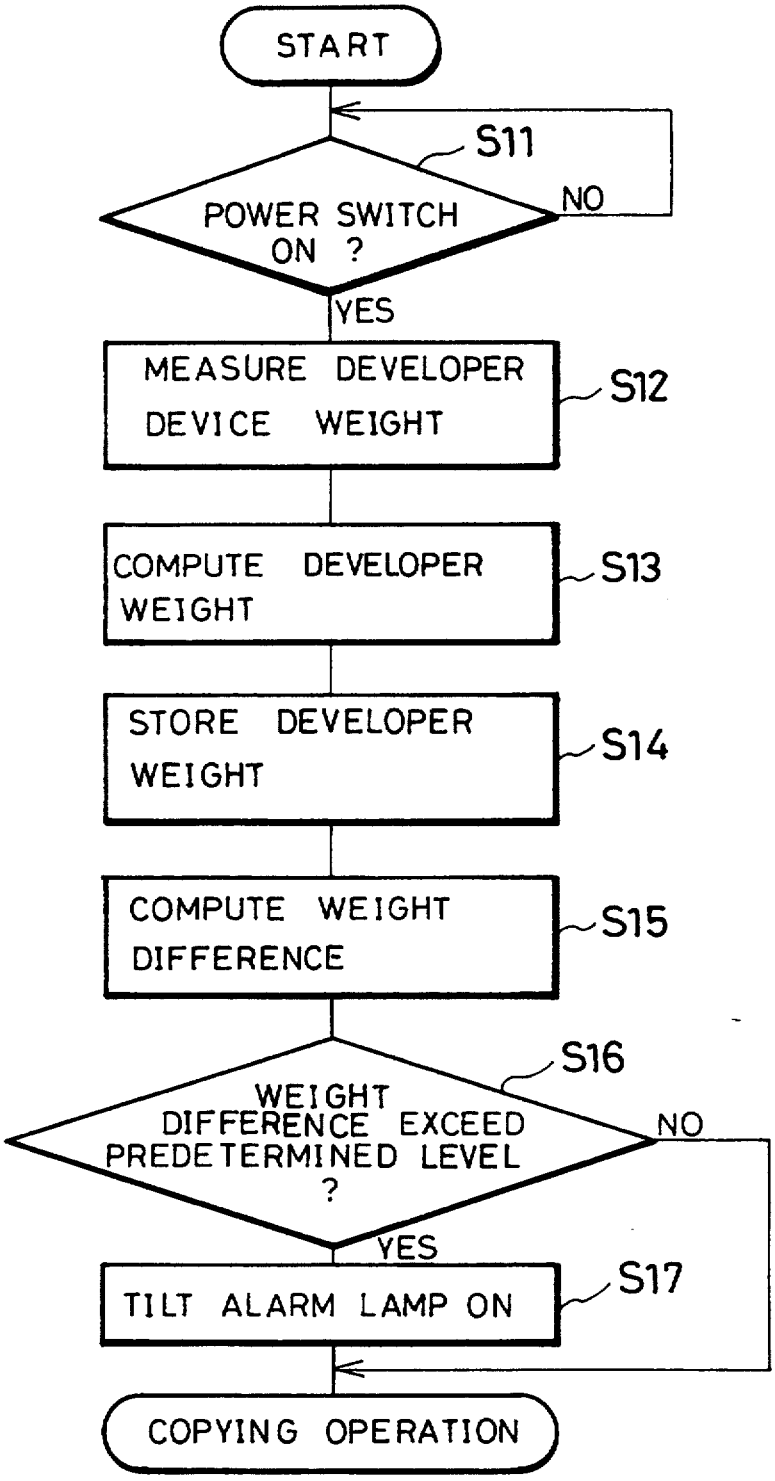
FIG. 6 is a flow chart showing a control by a control device in the copying machine based on a measured weight of the developing device.

Next, the control operation for detecting the tilt of the developing device 8 based on the weight of the developing device 8 measured by the device weight measuring plate 26 will be explained with reference to the flow chart of FIG. 6.

First, it is determined whether or not the power switch of the copying machine is turned ON (S11). If the power switch of the copying machine is turned ON, the weight of the developing device 8 is measured (S12). Based on a measured weight of the developing device 8, the quantity of the developer material in the developer vessel 16 is computed according to the above equation (S13). Next, the computed weight of the developer material is stored in the developer weight memory 38 (S14). Next, a difference between a computed weight of the developer material and a weight of the developer material most currently stored in the developer weight memory 38 is computed (S15).

Next, it is determined whether or not the difference exceeds a predetermined level (S16). If not, it is set in the wait state for a copying operation.

On the other hand, if it is determined that the difference exceeds the predetermined level in S16, the tilt alarm lamp 37 is set ON (S17) so as to inform the user of the tilt of developing device 8. Thus, the user can set the position of the copying machine, i.e., the developing device 8 back to the horizontal position. After setting the tilted the developing device 8 back to the horizontal position, it is set in a wait state for a copying operation.

As described, according to the arrangement of the developing device 8 of the present embodiment, by computing the difference between a computed quantity of the developer material in the developer vessel 16 and the most currently stored quantity of the developer material in the developer vessel 16, a change in the quantity of the developer material in the developer vessel 16 can be detected, thereby detecting the change in the discharged quantity of the developer material in the developer vessel 16.

In the above arrangement, if the currently measured quantity of the developer material in the developer vessel 16 is smaller than the previously stored quantity of the developer material in the developer vessel 16, the difference shows a positive value. In this state, a sufficient quantity of the developer material in the developer vessel 16 cannot be ensured, thereby detecting that the developer vessel 16 is tilted in the direction where the discharge opening 24 is placed at relatively lower position than the reference position. On the other hand, if the measured quantity of the developer material in the developer vessel 16 is larger than the most currently stored quantity of the developer material in the developer vessel 16, the difference shows a negative value. In this case, the quantity of the developer material in the developer vessel 16 exceeds the appropriate quantity, thereby detecting that the developer vessel 16 is tilted in the direction where the discharge opening 24 is placed at relatively upper position that the reference position.

In the above arrangement, in the case where the developing device 8 is tilted in the direction where the discharge opening 24 is placed at relatively upper position or in the direction where the discharge opening 24 is placed at relatively lower position, if the weight difference exceeds the predetermined level, the control device sends out an alarm signal so as to inform the user that the developing device 8 is tilted by lightening the tilt alarm lamp 37.

As described, even if the developing device 8 is tilted, the problem that the developer material in the developer vessel 16 is excessively reduced or increased, or the quality of the image is reduced can be prevented.

In the arrangement of the above embodiment, when the weight difference exceeds the predetermined level, the control device 32 sets the tilt alarm lamp 37 ON so as to inform it to the user. However, the present invention is not limited to the above arrangement. For example, it may be arranged so as to stop the copying operation by the control device 32.

Another embodiment of the present invention will be explained below with reference to FIG. 2, FIG. 7, FIG. 8 and FIG. 9. For convenience, the same reference numerals indicate the same elements as those of the previous embodiment, and therefore the explanations thereof shall be omitted here.

Figure 7:
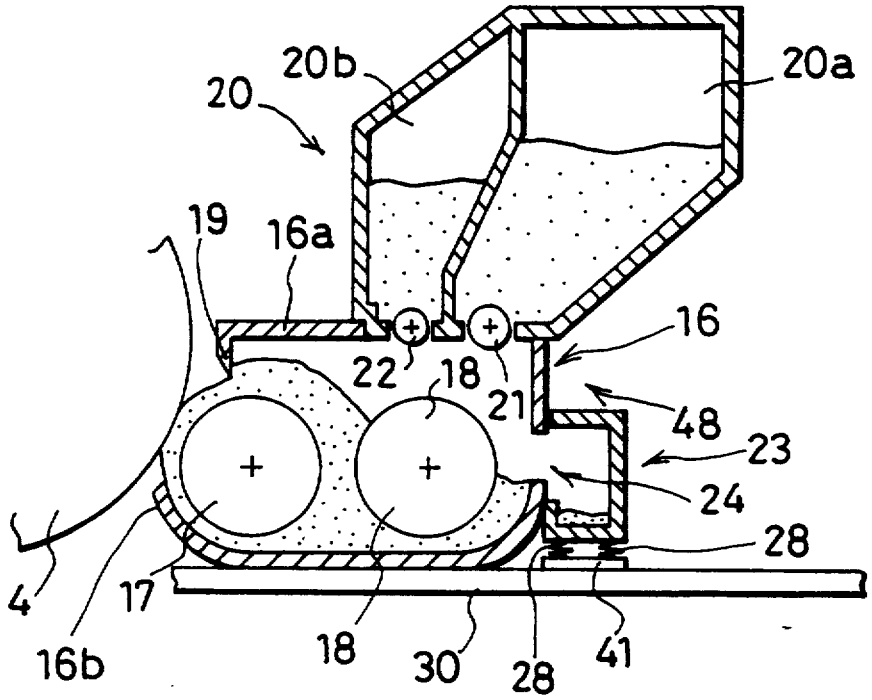
FIG. 7 is a longitudinal sectional view showing the developing device in another embodiment of the present invention.

A developing device 48 of the present embodiment is provided in a copying machine shown in FIG. 2. As shown in FIG. 7, the developing device 48 includes an enclosed developer vessel 16. On the side face **16*b* of the developer vessel 16, a collecting case 23 is provided so as to be freely detachable with respect to a discharge opening 24. Further, under the bottom surface of the collecting case 23, a plurality of springs 28 are provided in the direction toward a lower frame 30. The bottom ends of the springs 28 are connected to a collecting case weight measuring plate 41 (collecting case weight measuring means) provided on the lower frame 30. The side face 16*b* of the developer vessel 16 is fixed to the lower frame 30. The collecting case 23 is secured so as to be freely swung upward and downward with respect to the developing device 48. In the above arrangement, since the collecting case weight measuring plate 41 is provided, only the weight of the collecting case 23 can be measured separately from the developing device 48** main body.

The weight of the collecting case 23 is measured by the collecting case weight measuring plate 41 per every predetermined number of copies, and it is stored in a collecting case weight memory 43 (collecting case weight memory means) connected to a control device 32 (to be described later).

Figure 8:
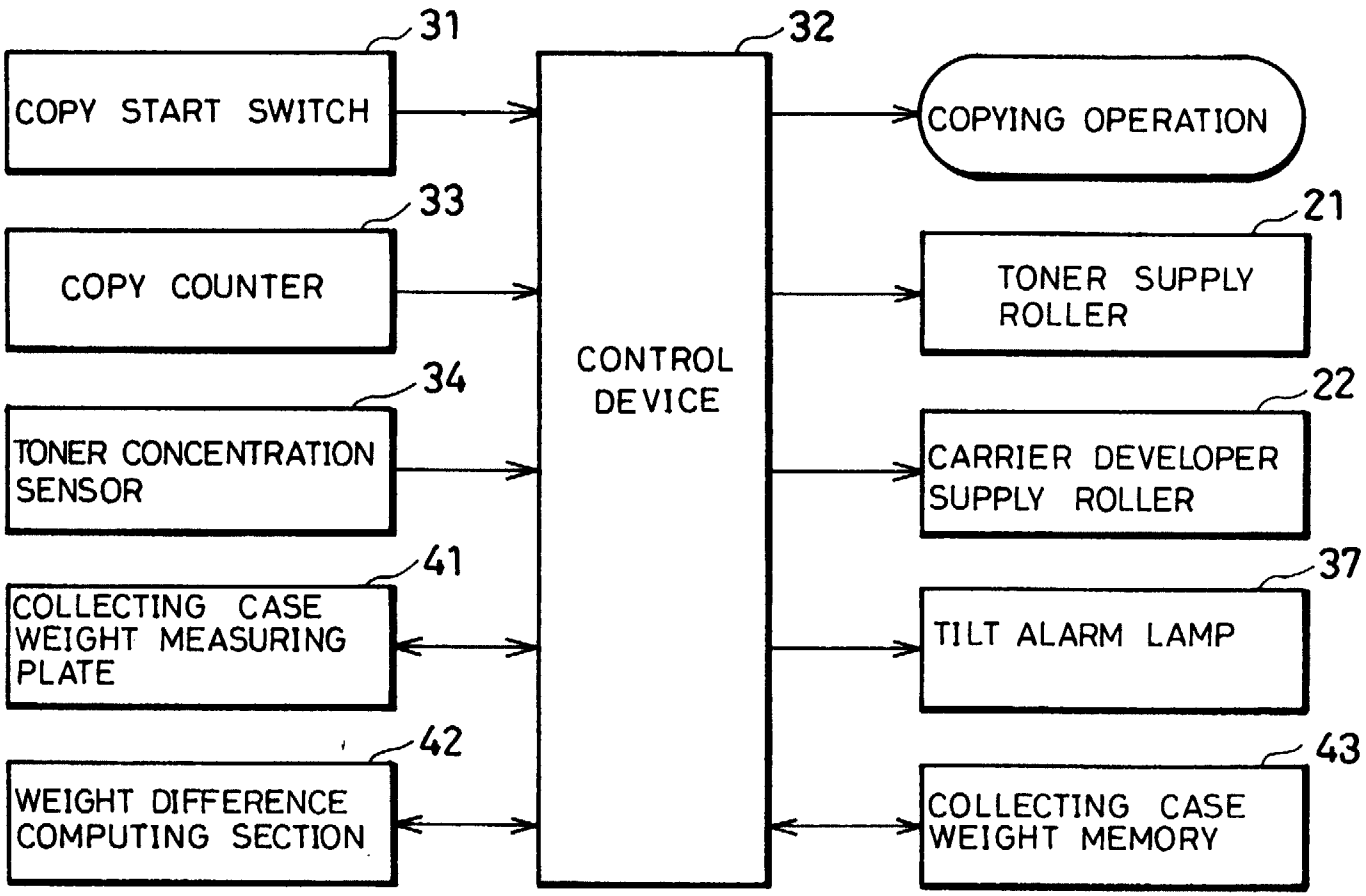
FIG. 8 is a block diagram of a control device in the copying machine provided with developing device of FIG. 7.

As shown in FIG. 8, the control device 32 controls the toner supply roller 21 and the carrier developer supply roller 22 based on the data from the toner concentration sensor 34 and the copy counter 33.

The control device 32 is connected to the collecting case weight measuring plate 41 for measuring the weight of the collecting case 23 for collecting therein the developer material discharged from the developer vessel 16, a collecting case weight memory section 43 for storing therein the weight of the developer material collecting case 23 measured by the collecting case weight measuring plate 41 and the weight difference computing section 42. More specifically, it is controlled by the control device 32 such that the weight of the collecting case 23 measured by the collecting case weight measuring plate 41 is stored in the collecting case weight memory section 43, and that the difference from the weight of the collecting case 23 previously stored in the collecting case weight memory section 43 is computed by the collecting case weight difference computing section 42.

In the collecting case weight computing section 42, the currently measured weight of the collecting case 23 is subtracted from the previously stored weight of the collecting case 23. The weight of the collecting case 23 is measured after every predetermined number of copies.

The difference in the weight of the collecting case 23 with respect to the weight of the developer material supplied into the developer vessel 16 is maintained in the same quantity as long as the developer vessel 16 is placed in the horizontal state. Therefore, by detecting a change in the weight of the developer material collected in the collecting case 23, the tilt of the developing device 48 if occurs can be detected. For example, if the difference in the weight is smaller than the predetermined value, it can be determined that the appropriate quantity of the developer material is not discharged from the developer vessel 16. As a result, the tilt of the developing device 48 is detected in the direction where the discharge opening 24 is located at relatively upper position. On the other hand, if the difference is greater than the predetermined value, it is determined that an excessive quantity of the developer material is discharged from the developer vessel 16. As a result, the tilt of the developing device 48 is detected in the direction where the discharge opening 24 is located at relatively lower position.

The control device 32 is connected to a tilt alarm lamp 37 composed of a light emitting diode (alarm means) for alarming that the developing device 48 is tilted. The tilt alarm lamp 37 includes the same drive circuit as that of the previous embodiment, and it is arranged such that when the weight difference of the collecting case 23 exceeds the predetermined level, the tilt alarm lamp 37 is set ON.

The tilt alarm lamp 37 is provided on an operation panel (not shown) so that it can be easily seen by the user. The tilt alarm lamp 37 may be arranged arranged such that when it is lightened, it gives a sound.

Figure 9:
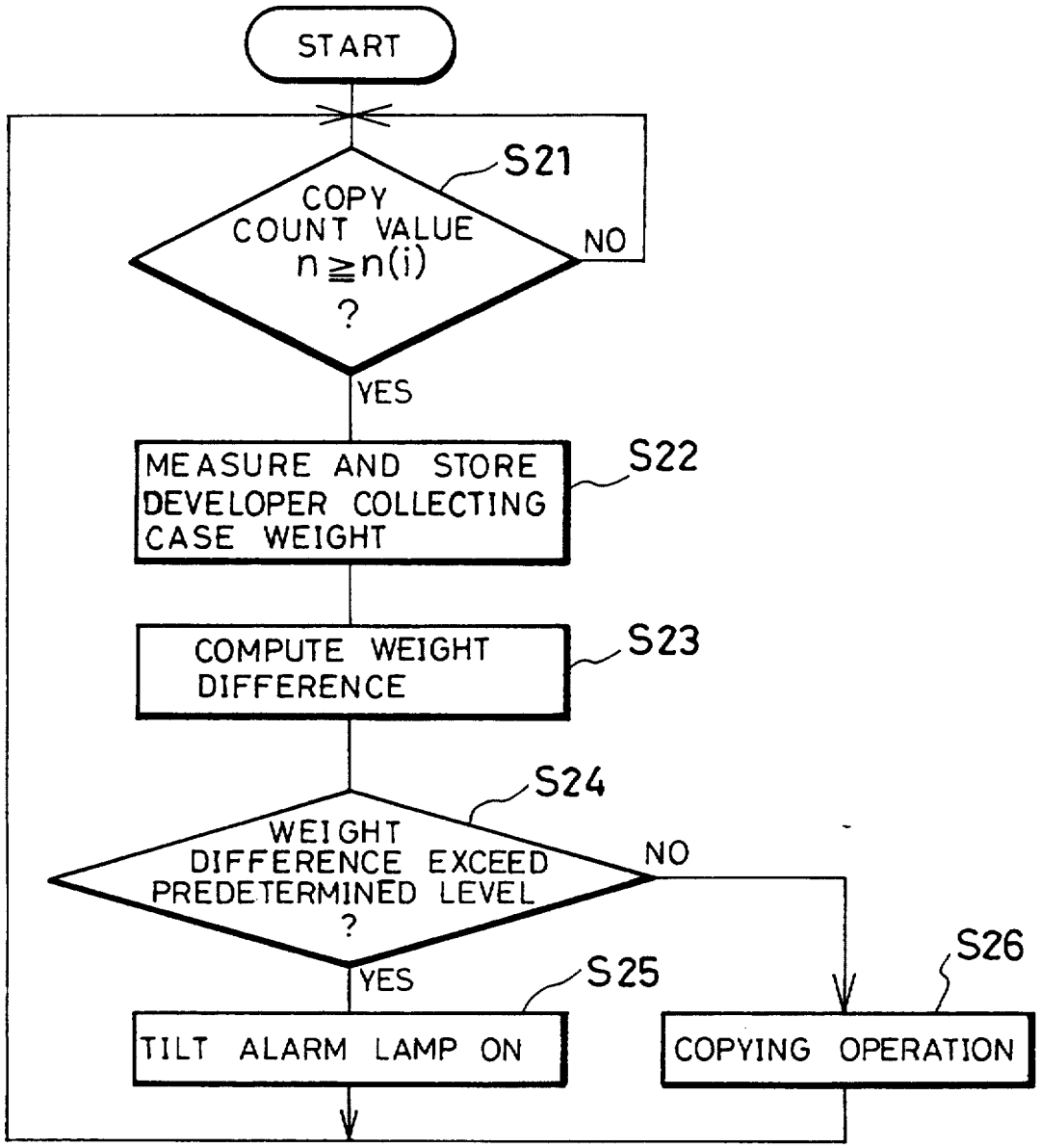
FIG. 9 is a flow chart showing a control by a control device in the copying machine based on a measured weight of the developing device.

In the above arrangement, processes for controlling the tilt of the developing device 48 will be explained in reference to the flow chart of FIG. 9.

First, it is determined whether or not a copy count value reaches a predetermined value (S21). If so, the weight of the collecting case 23 is measured by the collecting case weight measuring plate 41, and the measured value is stored in the collecting case weight memory 43 (S27).

Next, in the collecting case weight difference computing section 42, the difference in the weight between a measured weight of the collecting case 23 and the most currently stored weight of the collecting case 23 is computed (S23). Then, it is determined whether or not the difference exceeds a predetermined level (S24). If it is determined that the difference does not exceed the predetermined level, the copying operation is executed (S26).

On the other hand, if it is determined that the difference exceeds the predetermined level in S24, the tilt alarm lamp 37 is set ON (S25) so as to inform the user of the tilt of the developing device 48. Then, after the user sets the tilted developing device 48 back to the horizontal position, a copying operation is executed again, and the sequence moves back to S21.

With the above control, in the case where the quantity of the developer material discharged from the developer vessel 16 and collected in the collecting case 23 is not appropriate, it is determined that the developing device 48 is tilted in the direction where the discharge opening 24 is placed at a relatively upper position or in the direction where the discharge opening 24 is placed at a relatively lower position. In this case, the user is informed of the tilt of the developing device 48 by the tilt alarm lamp 37.

Therefore, when the developing device 48 is tilted in the direction where the discharge opening 24 is placed at relatively lower position, the following problem can be prevented: the copied image quality deteriorates due to the great reduction in the quantity of the developer material in the developer vessel 16 as being used in the above tilted state. On the other hand, when the developing device 48 is tilted in the direction where the discharge opening 24 is placed at relatively upper position, the following problem can be prevented: the copied image quality deteriorates due to an excessive increase of the quantity of the developer material in the developer vessel 16 as being used in the above tilted state.

In the above arrangement, the weight of the collecting case 23 is measured after carrying out every predetermined number of copies. However, the present invention is not limited to the above arrangement. For example, it may be arranged such that the weight of the collecting case 23 is measured after every predetermined elapse of time by the timer after turning ON the power of the copying machine.

In the present embodiment, when the difference in the weight of the collecting case 23 exceeds the predetermined level, the tilt alarm lamp 37 is lighted by the control device 32. However, the present invention is not limited to the above arrangement. For example, it may be arranged so as to stop the copying machine by the control device 32.

A still another embodiment of the present invention will be described below with reference to FIG. 2 and FIG. 10 through FIG. 15. For convenience, the same reference numerals indicate the same components as those of the previous embodiments, and therefore the descriptions thereof shall be omitted here.

Figure 10:
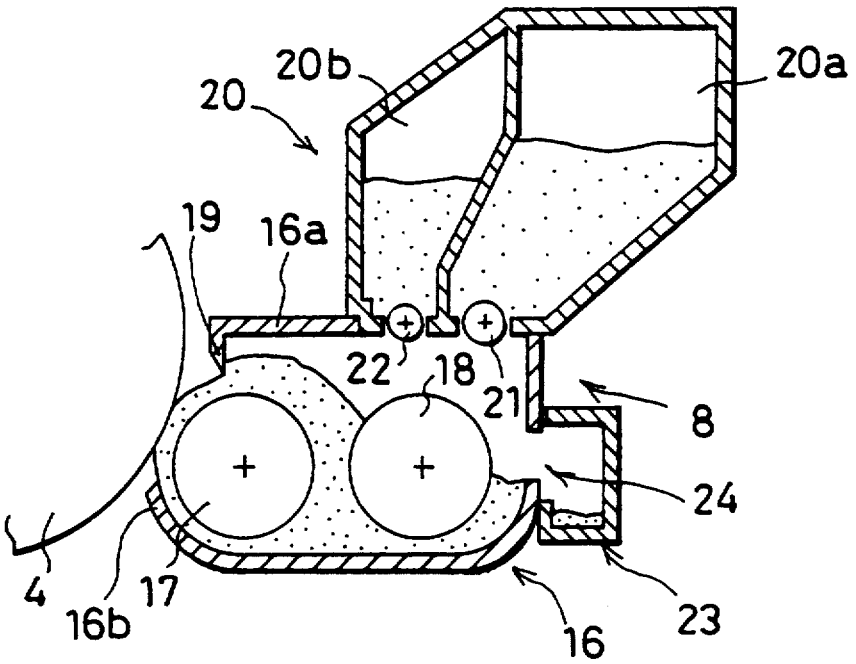
FIG. 10 is a longitudinal cross sectional view showing a developing device in accordance with another embodiment of the present invention.
Figure 11:
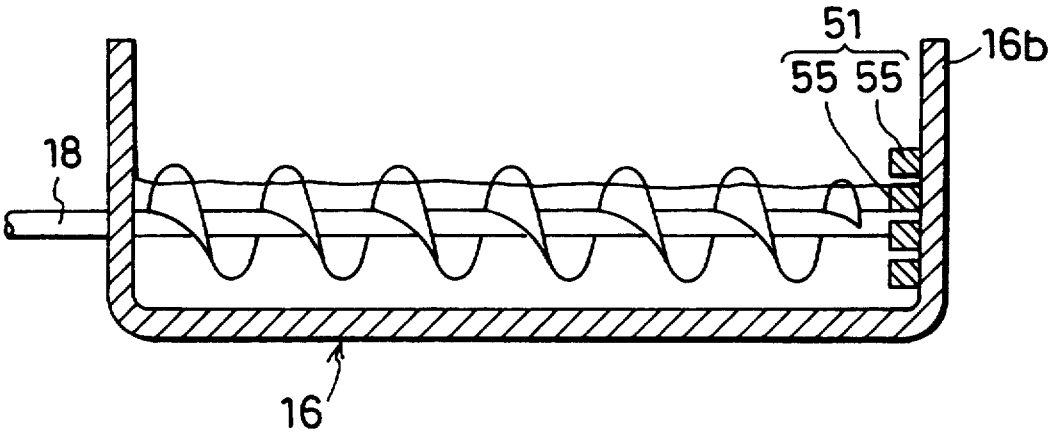
FIG. 11 is a cross sectional view of the developer vessel in the developing device of FIG. 10.

A developing device 58 of the present embodiment is provided in a copying machine shown in FIG. 2. The structure of the developing device 58 is as shown in FIG. 10 and FIG. 11. In FIG. 11, a height detecting section 51 (height detecting means) for detecting the height of the developer material in the developer vessel 16 is provided on an inner surface of a side face **16*b* of the developer vessel 16 on one end side of the stirring roller 18. The height detecting section 51 is composed of a plurality of optical sensors 55** provided with predetermined intervals.

Figure 12:
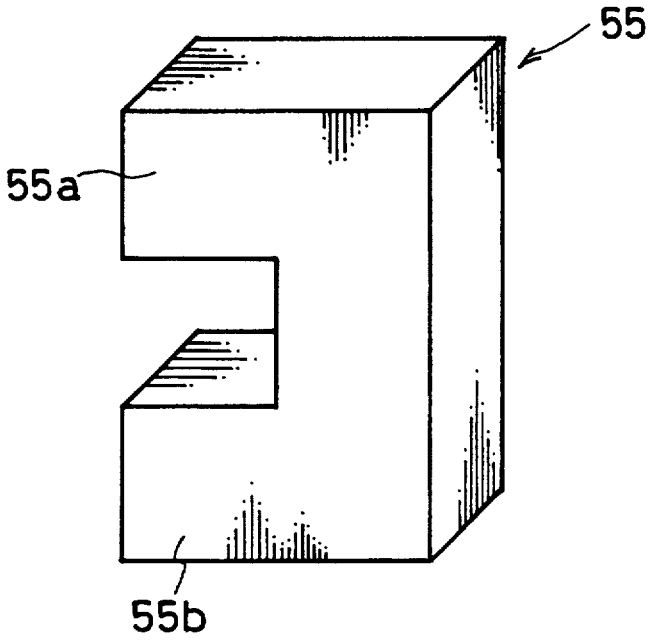
FIG. 12 is a perspective view of an optical sensor provided in the developer vessel.
Figure 13:
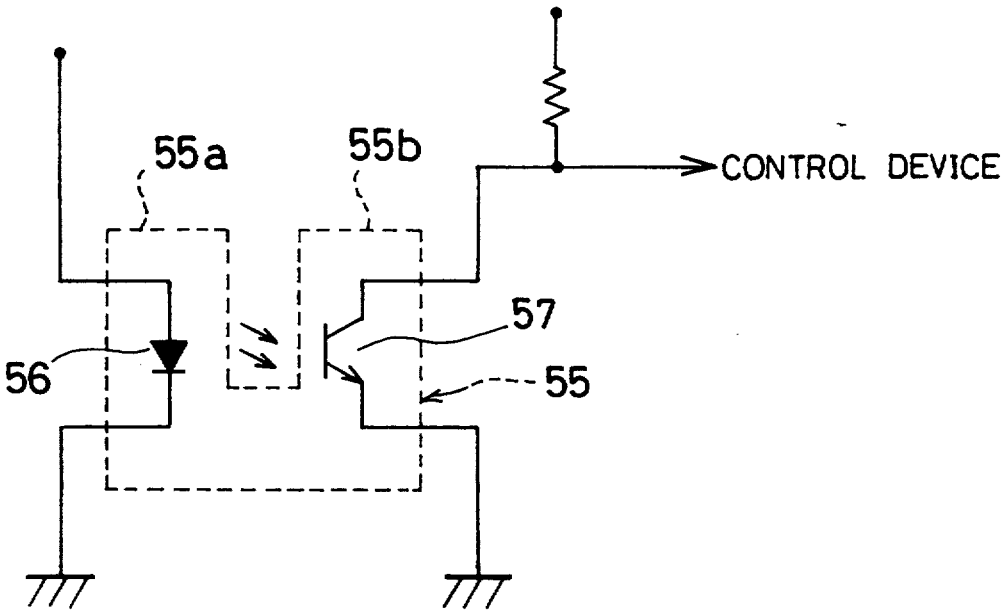
FIG. 13 is a drive circuit diagram of an optical sensor.

As shown in FIG. 12, an optical sensor 55 is composed of a light emitting section **55*a* and a light receiving section 55*b*. As shown in FIG. 13, the drive circuit of the optical sensors 55 is arranged so as to include a light emitting diode 56 (light emitting element) and a photo transistor 57 (light receiving element) respectively provided in the light emitting section 55*a* and the light receiving section 55*b***.

More concretely, a light projected from a light emitting diode 56 provided in the light emitting section **55*a* is received by a photo transistor 57 provided in the light receiving section 55*b* and outputs a light receiving signal to the control device 32** after converting it to an electric signal.

Therefore, as shown in FIG. 11, the plurality of optical sensors 55 are provided along the inner wall of the developer vessel 16 in an up-down direction, and the height of the developer material in the developer vessel 16 is detected by detecting that from which optical sensor 55, a receiving signal is inputted to the control device 32.

Figure 14:
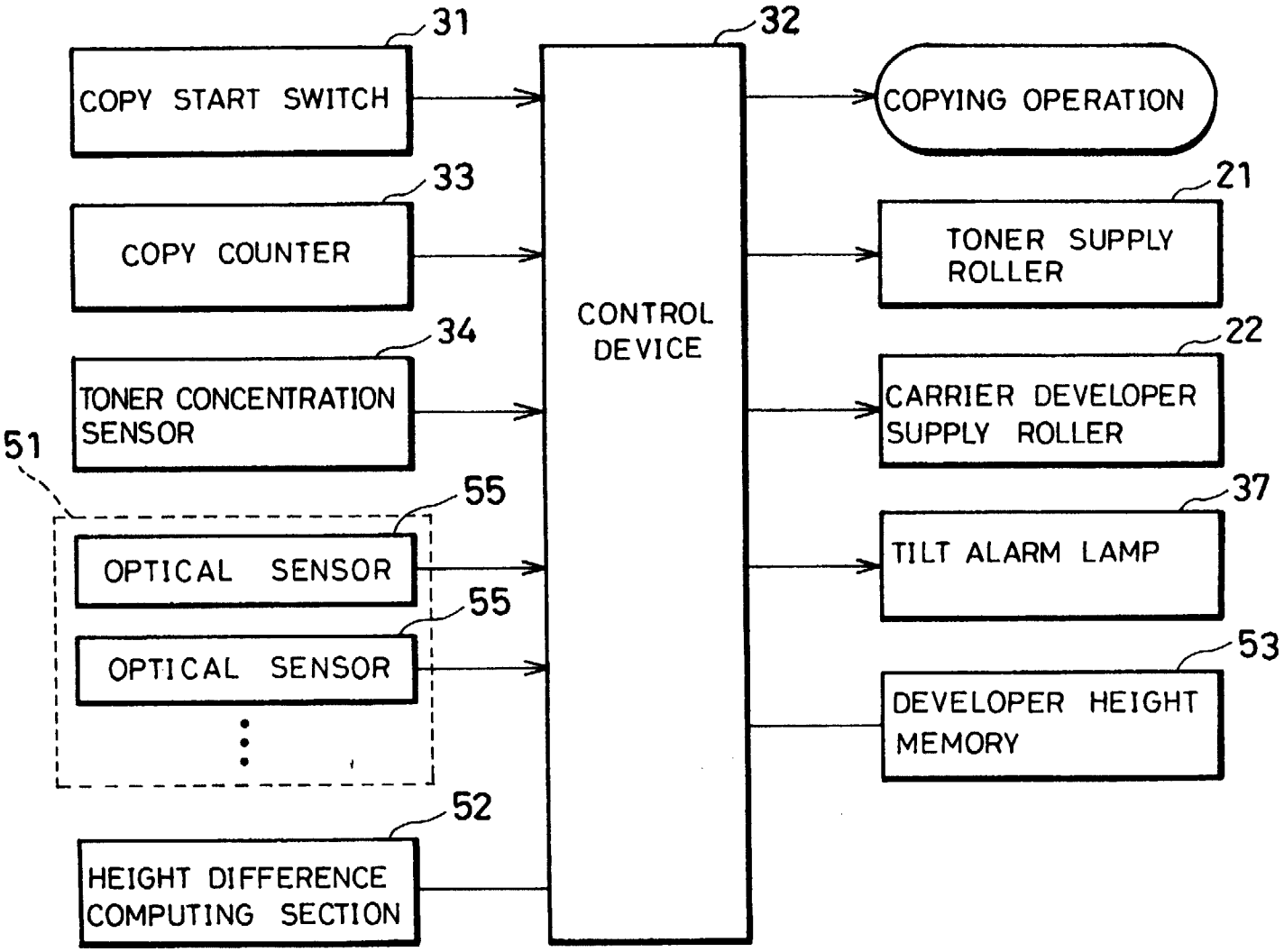
FIG. 14 is a block diagram of a control device in the copying machine.

As shown in FIG. 14, the control device 32 controls the toner supply roller 21 and the carrier developer supply roller 22 based on the data from the toner concentration sensor 34 and the copy counter 33 in the same manner as the previous embodiment.

The plurality of optical sensors 55 and a developer height memory 53 (developer material memory means) are connected to the control device 32. The developer height memory 53 is provided for storing therein the height of the developer material in the developer vessel 16. When the height of the developer material in the developer vessel 16 is detected based on a light receiving signal by the optical sensor 55, the height of the developer material is stored in the developer height memory 53. Furthermore, a height difference computing section 52 (height difference computing means) is provided for computing a difference between the detected height of the developer material and the most currently stored height of the developer material. When the difference exceeds a predetermined level, the tilt alarm lamp 37 is set ON, thereby informing the user of the tilt of the developing device 58.

In the height difference computing section 52, the currently detected height of the developer vessel 16 is subtracted from the most currently stored height of the developer material. In order to detect the height of the developer material under the same condition, the height of the developer material in the developer vessel 16 is detected after stirring it by the stirring roller 18.

As to the height of the developer material in the developer vessel 16, as long as a constant quantity of the developer material is supplied and the developing device 58 is maintained in the horizontal position, the height of the developer material is maintained constant only by driving the stirring roller 18. Therefore, if the difference in the height of the developer material in the developer vessel 16 is negative, i.e., when the height of the developer material in the developer vessel 16 is higher than the most currently computed height of the developer material, it is determined that an appropriate quantity of the developer material is not discharged from the developer vessel 16. As a result, it can be detected that the developing device 58 is tilted in the direction where the discharge opening 24 is placed at relatively upper position. On the other hand, if the difference shows the positive value, i.e., the difference is greater than a predetermined value, it is determined that an excessive quantity of the developer material is discharged from the developer vessel 16. As a result, it can be detected that the developing device 58 is tilted in the direction where the discharge opening 24 of the developer material is placed at relatively lower position.

Figure 15:
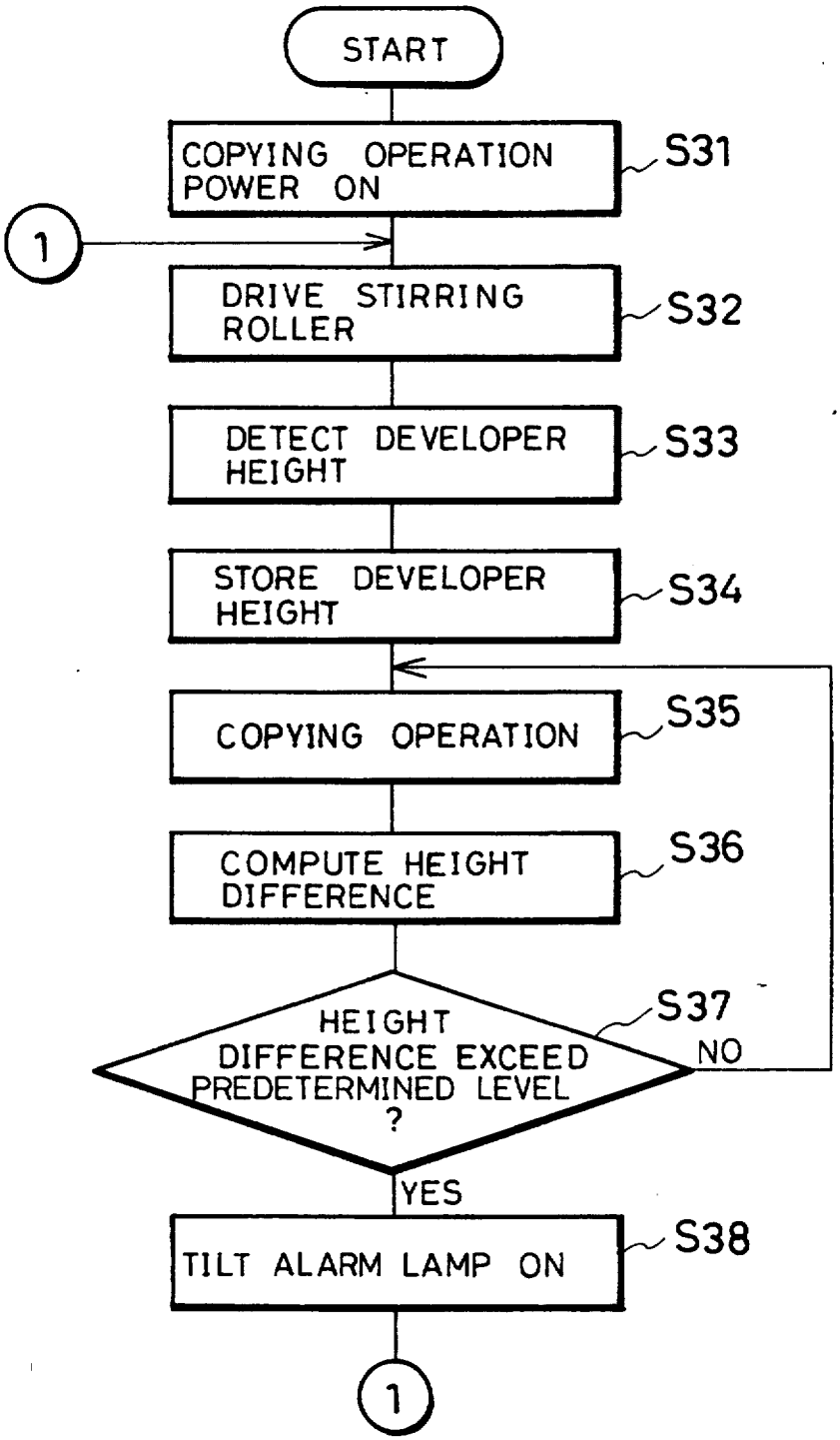
FIG. 15 is a flow chart showing a control by the control device in the copying machine based on a detected height of the developer material in the developer vessel.

In the above embodiment, the control process for informing the user that the developing device 58 is tilted will be explained below in reference to the flow chart of FIG. 15.

First, a power switch of the copying machine is turned ON (S31). Then, the stirring roller 18 in the developer vessel 16 is driven so as to obtain a uniform height of the developer material (S32). After obtaining the uniform height of the developer material, the height of the developer material in the developer vessel 16 is detected by the height detecting section 51 (S33). Then, a detected height of the developer material is stored in the developer height memory 53 (S34).

Next, a copying operation is carried out by pressing a copy start switch 31 (S35). The height of the developer material in the developer vessel 16 is detected in order, and the difference between the detected height of the developer material in the developer vessel 16 and the height of the developer material most currently stored in the developer height memory is computed (S36). Here, it is determined whether or not the difference exceeds a predetermined level (S37). If it is determined that the difference does not exceed the predetermined level, a copying operation is continued, and the sequence moves to S35 where it is set in a wait state for the next copying operation.

On the other hand, when it is determined in S37 that the difference exceeds the predetermined level, the tilt alarm lamp 37 is set ON so as to inform the user of the tilt of the developing device 58 (S38). After the tilted developing device 58 is set back to the horizontal position by the user, the sequence goes back to S32.

In the described control processes, the height of the developer material in the developer vessel 16 is detected at every predetermined interval, and by computing the difference between the height of the developer material and the most currently stored height of the developer material, the tilt degree of the developing device 58 can be detected. As a result, when the developing device 58 is tilted in the direction where the discharge opening 24 is placed in relatively upper position or in the direction where the discharge opening 24 is placed in relatively lower position, the tilt alarm lamp 37 is turned ON for sending out a warning.

Therefore, the problem that the quality of the image is lowered because the developing device 58 is being used in the tilted state can be prevented.

In the above arrangement, the height of the developer material in the developer vessel 16 is measured after carrying out every predetermined number of copies. However, the present invention is not limited to the above arrangement. For example, it may be arranged such that the height of the developer material in the developer vessel 16 is measured after every predetermined elapse of time by the timer after turning ON the power of the copying machine.

Furthermore, in the present embodiment, the optical sensors 55 have been used. However, the present invention is not limited to this arrangement, and sensors of other types are equally adopted.

A still another embodiment of the present invention will be described below with reference to FIG. 16 through FIG. 23. For convenience, the same reference numerals indicate the same components as those of the previous embodiments, and therefore the descriptions thereof shall be omitted here.

Figure 16:
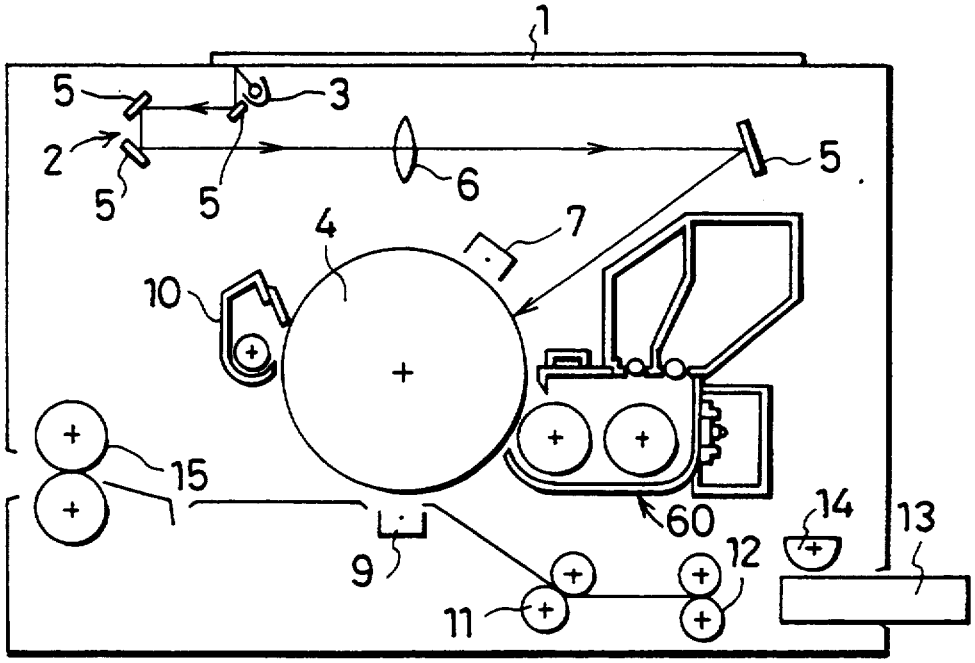
FIG. 16 is an explanatory view showing an entire configuration of the copying machine provided with the developing device of the present invention.
Figure 17:
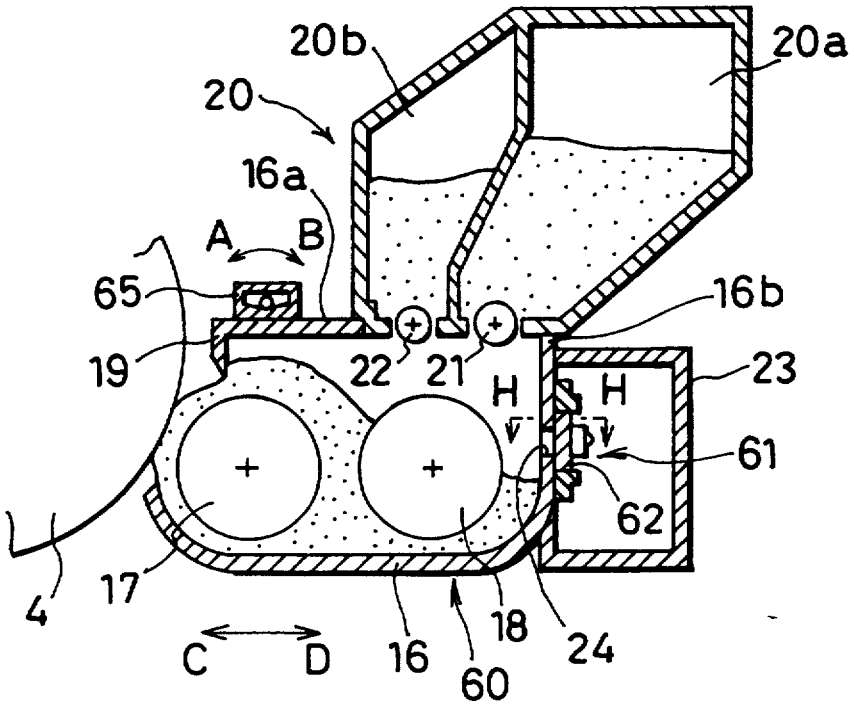
FIG. 17 is a longitudinal sectional view showing the developing device in accordance with one embodiment of the present invention.

A developing device 60 of the present embodiment is provided in a copying machine shown in FIG. 16. As shown in FIG. 17, the developing device 60 is provided with an enclosed developer vessel 16. Further, a collecting case 23 with an opening is removably secured to the side face **16*b* of the developer vessel 16. An opening and closing mechanism 61 is provided so as to open and close the discharge opening 24 along the side face 16*b* of the developer vessel 16**.

Figure 18A:
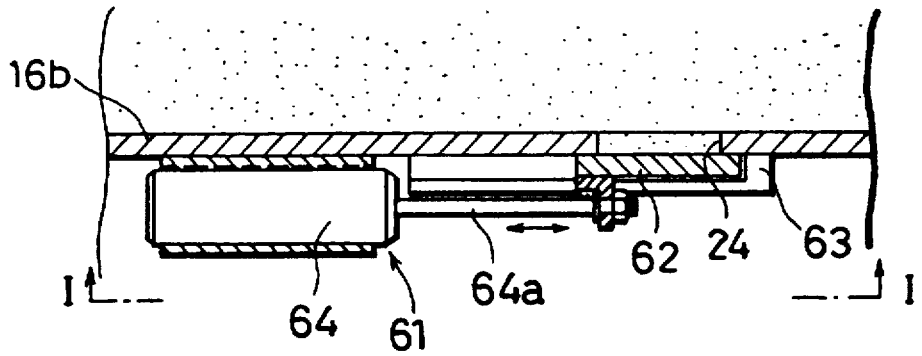
FIG. 18(*a*) is a cross-sectional view taken on line H—H of FIG. 17.
Figure 18B:
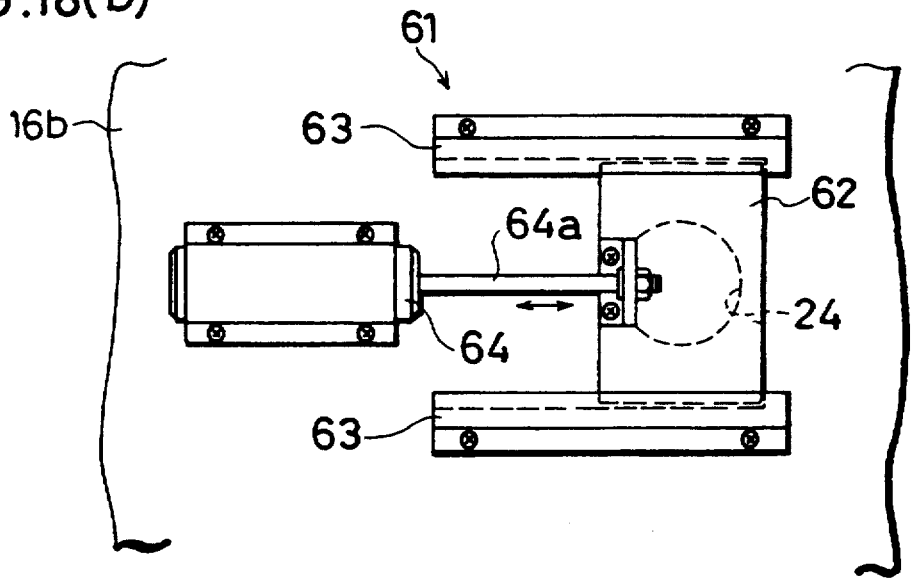

As shown in FIG. 18(*a*) and FIG. 18(*b*), the opening and closing mechanism 61 is composed of a plate-shaped opening and closing plate 62, guide plates 63 and an opening/closing solenoid 64 (drive means). The opening and closing plate 62 is provided so as to freely slide along the Side face **16*b*. The guide plates 63 are provided on both sides of the opening and closing plate 62 for guiding the sliding of the opening and closing plate 62. The opening/closing use solenoid 64 is provided so that the leading end of a plunger 64*a* is connected to the opening and closing plate 62. When the opening/closing use solenoid 64 is not energized (OFF), the plunger 64*a* is maintained at the forward position. As a result, the opening and closing plate 62 is maintained at the position where it closes the discharge opening 24. On the other hand, when the opening/closing use solenoid 64 is welded (ON), the plunger 64*a* is moved backward. As a result, the opening/closing use solenoid 64 is moved so as to open the the discharge opening 24**.

Figure 19A:
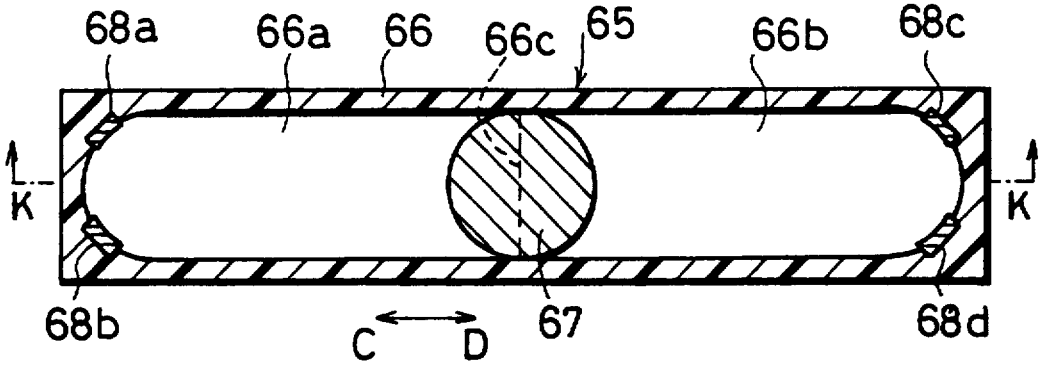
FIG. 19(*a*) is a cross-sectional view of a tilt sensor shown in FIG. 17.
Figure 19B:
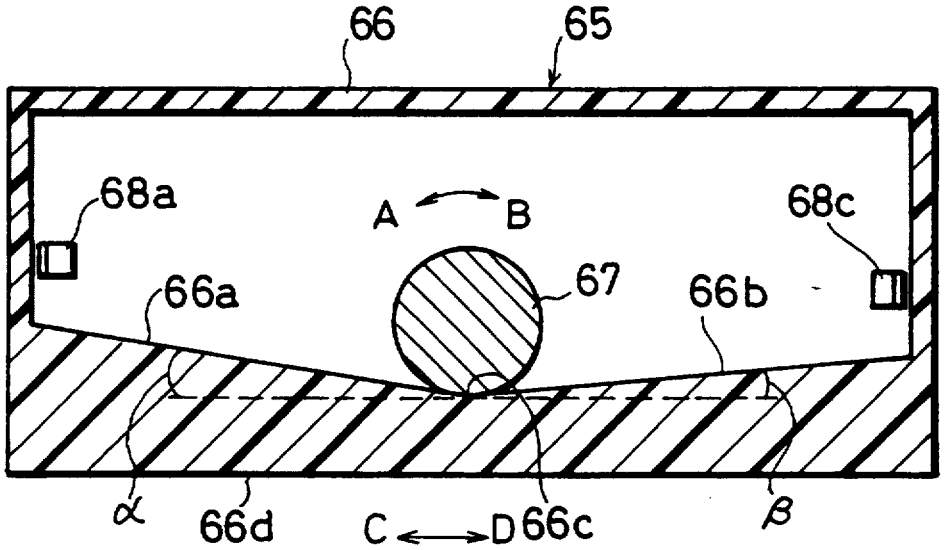

On a ceiling **16*a* of the developer vessel 16, a tilt sensor 65 (tilt detecting means) for detecting the tilt of the developer vessel 16 is provided. The tilt sensor 65 is shown in FIG. 19**(*a*) which is a transverse sectional view of the tilt sensor 65 and FIG. 19(*b*) which is a cross-sectional view taken on line K—K of FIG. 19(*a*). The tilt sensor 65 is composed of a frame 66 made of a dielectric material such as a resin material, an electrically conductive ball 67 made of an electrically conductive material such as a metal provided so as to be freely rotatable within the frame 66 and four contact terminals **68*a*–68*d* provided on the frame 66**.

An upper surface of a bottom part of the frame 66 forms a V-shape by-an inclined face **66*a* and an inclined face 66*b* so as to have a bottom 66*c* at the center. The inclined face 66*a* is inclined at $\alpha$ to a flat face 66*d* of the frame 66, and the inclined face 66*b* is inclined at $\beta$ to the flat face 66*d* of the frame 66**, where tilt angles $\alpha$ and $\beta$ satisfy the following inequality: $\alpha \geqq \beta$.

The electrically conductive ball 67 is provided within the frame 66. Among the contact terminals **68*a* 68*d*, the contact terminals 68*a* and 68*b* are provided on the side face side in the direction of C so that the faces to be in contact with the electrically conductive ball 67 are exposed, whereas the contact terminals 68*c* and 68*d* are provided on the side face side in the direction of D so that the faces to be in contact with the electrically conductive ball 67 are exposed. Each contact terminal is connected to a wire (not shown), and as will be described later, the contact terminals 68a and 68b form a switch terminal, and the contract terminals 68c and 68d form another switch terminal. When the tilt sensor 65 is maintained in a horizontal state, the electrically conductive ball 67 is placed at the bottom 66c of the frame 66. On the other hand, when the inclined face 66a of the tilt sensor 65 is inclined in the direction of A over the horizontal state, the electrically conductive ball 67 rotates so as to move in the direction of C along the inclined face 66a until it comes in contact with contact terminals 68a and 68b. As a result, the contact terminals 68a and 68b are short-circuited. Similarly, when the inclined face 66b of the tilt sensor 65 is inclined in the direction of B over the horizontal state, the electrically conductive ball 67 rotates so as to move in the direction of D along the inclined face 66b until it comes in contact with the contact terminals 68c and 68d. As a result, the contact terminals 68c and 68d** are short-circuited.

The tilt sensor 65 is provided on the upper face 16a of the developer vessel 16 in such a way that the direction of C-D crosses the side face 16b, on which the discharge opening 24 is provided, at right angle and that the inclined face 66b is provided on the side of the discharge opening 24. Therefore, a predetermined tilt level of the developing device 60 in the direction of A with respect to the horizontal direction is defined as the tilt angle $\alpha$, and a predetermined tilt level of the developing device 60 in the direction of B is defined as the tilt angle $\beta$.

Figure 20:
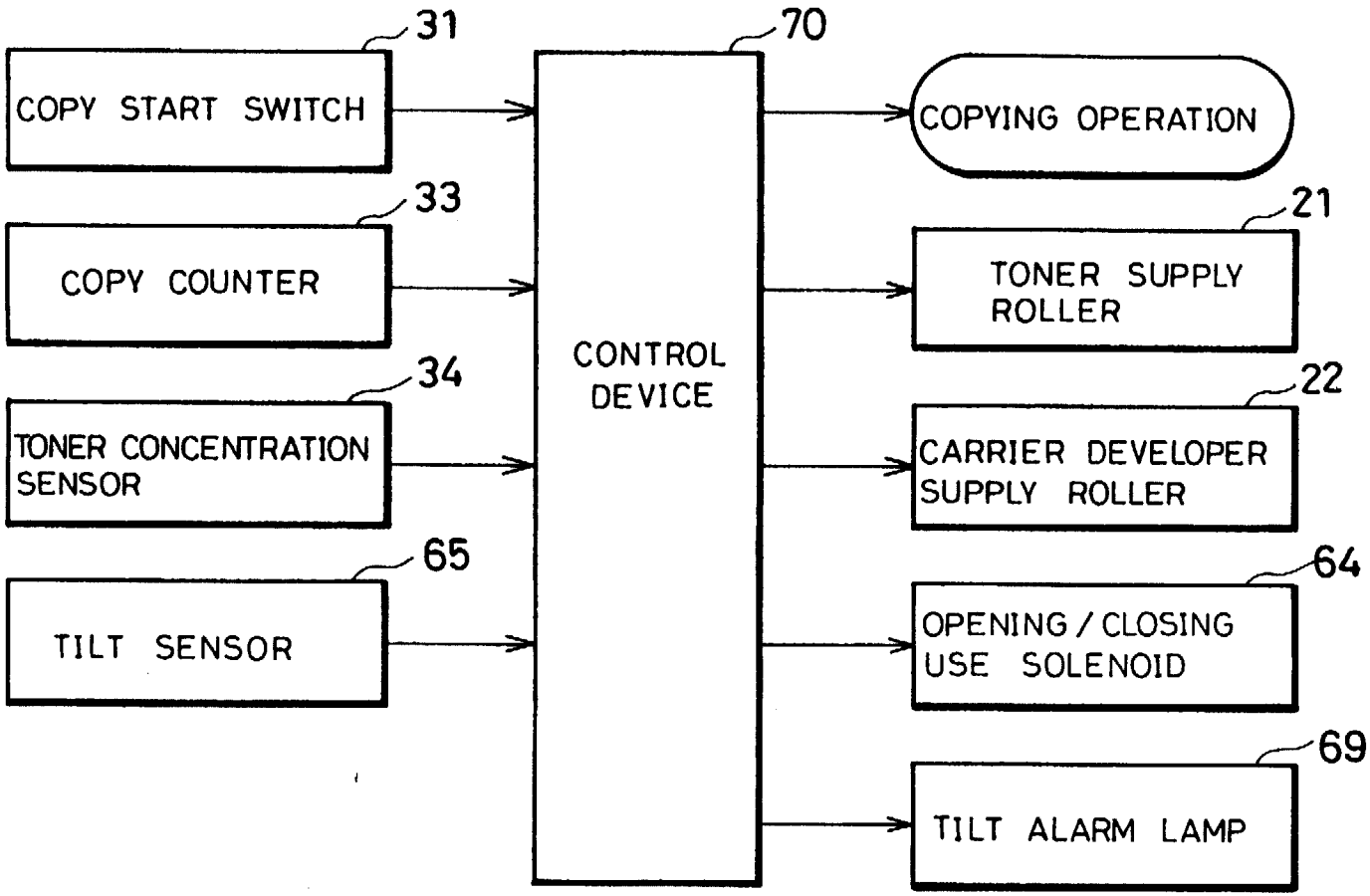
FIG. 20 is a block diagram of a control device in a copying machine.
Figure 21:
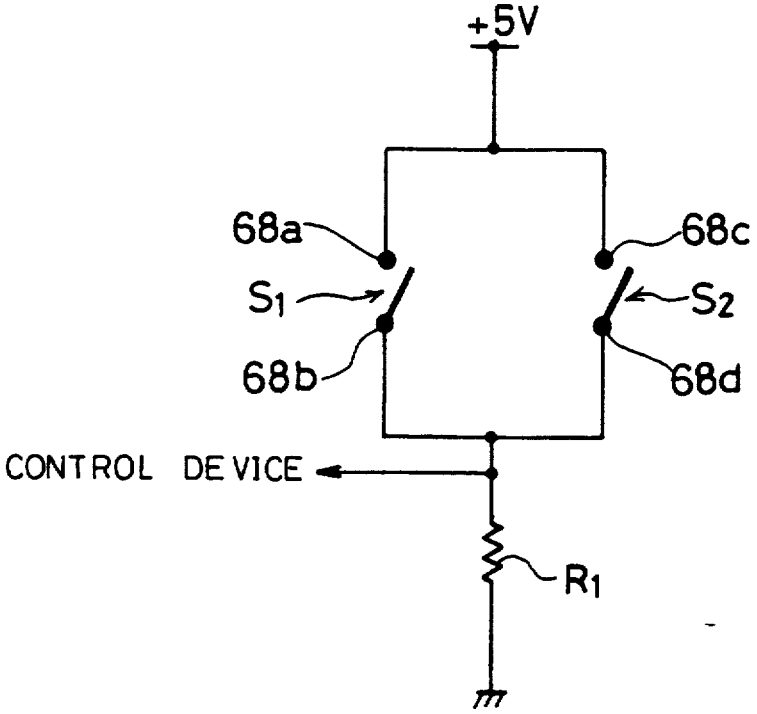
FIG. 21 is an equivalent circuit diagram of a tilt sensor.

As shown in FIG. 20, the tilt sensor 65 is connected to the control device 70 composed of a microcomputer. The connected state of the tilt sensor 65 can be shown in an equivalent circuit, for example as shown in FIG. 21. Voltage is applied to one end of switches $S_1$ and $S_2$ connected in parallel, and the other end is connected to one end of a resist $R_1$ and to the control device 70. Here, the contact terminals 68a and 68b and the electrically conductive ball 67 serve as the switch $S_1$, and the terminals 68c and 68d and the electrically conductive ball 67 serve as the switch $S_2$. Therefore, in both cases where the developing device 60 is not tilted at all and it is tilted but within a predetermined range, the switches $S_1$ and $S_2$ are set OFF, and a signal of Low level is inputted to the control device 70. On the other hand, in the case where the developing device 60 is inclined over the predetermined range, either the switch $S_1$ or the switch $S_2$ is turned ON, and a current flows into the resist $R_1$, and further, a voltage is generated on both ends of the resist $R_1$, thereby inputting a signal of High level to the control device 70.

The control device 70 is connected to a tilt alarm lamp 69 (alarm means) composed of a light emitting diode which informs that the developing device 60 is inclined over a predetermined level. A drive circuit of the tilt alarm lamp 69 has the same configuration as that of the previous embodiment shown in FIG. 4. The tilt alarm lamp 69 is turned ON or OFF according to a High level signal or Low level signal from the control device 70.

The control device 70 controls the toner supply roller 21 and the carrier developer supply roller 22 based on data from the toner concentration sensor 34 and the copy counter 33 in the same manner as the previous embodiment.

Figure 22:
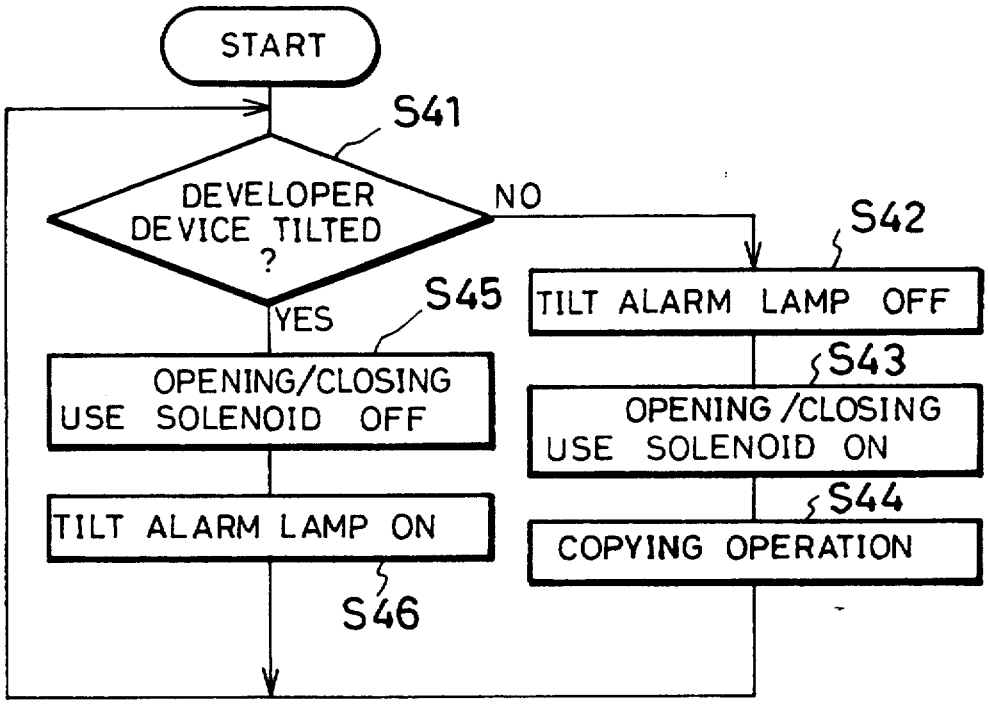
FIG. 22 is a flow chart showing a control by the control device based on an output form the tilt sensor.

The control processes of the control device 70 based on the detections by the tilt sensor 65 will be explained below in reference to FIG. 22.

The tilt of the developing device 60 is detected by the tilt sensor 65 (S41). If the developing device 60 is placed in the horizontal state, the electrically conductive ball 67 of the tilt sensor 65 is placed on the bottom 66c of the frame 66. In this state, both of the switches $S_1$ and $S_2$ shown in FIG. 21 are set OFF, thereby setting the tilt alarm lamp 69 OFF (S42). The opening/closing use solenoid 64 is turned ON (S43) so as to open the discharge opening 24. Thereafter, by operating the copy start switch 31, a copying operation is carried out (S44).

On the other hand, for example, when moving a copying machine provided with the developing device 60, the developing device 60 may be tilted in the direction of A or B as shown in FIG. 17. In this case, the electrically conductive ball 67 is moved in the direction of C or D and either the switch $S_1$ or the switch $S_2$ is turned ON (S41). As a result, the opening/closing use solenoid 64 is turned OFF so as to close the discharge opening 24 (S45). In the meantime, the tilt alarm lamp 69 is turned ON (S46) so as to inform that the copying operation is prohibited because the developing device 60 is tilted over the predetermined level, and thereafter the sequence moves back to S41. As a result, the user sets the tilted copying machine, i.e., the developing device 60 back to the horizontal position.

As described, according to the developing device 60 of the present embodiment, in both cases where the developing device 60 is tilted in the direction of A over the predetermined level, i.e., in the direction where the discharge opening 24 is placed at a relatively upper position, and where the developing device 60 is tilted in the direction of B over the predetermined level in the direction where the discharge opening 24 is placed at a relatively lower position, the discharge opening 24 is closed, and the above states are informed by means of the tilt alarm lamp 69. Therefore, even if the first case occurs, the problem that the quantity of the developer material in the developer vessel 16 is excessively reduced which causes the copied image quality to be lowered which would have occurred if the developing device 60 had been used in the tilted position can be prevented. Similarly, even if the second case occurs, the problem that an excessive quantity of the developer material is stored within the developer vessel 16 which causes the copied image quality to be lowered which would have occurred if the developing device 60 had been used in the tilted position can be prevented.

In the first case where the quantity of the developer material is greatly reduced, the copied image quality is more seriously lowered compared with the second case where the quantity of the developer material becomes excessive, because insufficient quantity of the developer material would cause the deterioration of the charging ability more badly. Therefore, by setting the respective predetermined tilt angles satisfy the inequality $\alpha \geqq \beta$, the predetermined tilt level of the developing device in the direction where the discharge opening 24 is placed at relatively lower position is set equal to or smaller than the predetermined tilt level of the developing device in the direction where the discharge opening 24 is placed at relatively upper position.

In the above embodiment, the discharge opening 24 is formed on the side face 16b of the developer vessel 16, which is positioned parallel to the axis of the stirring roller 18. However, it may be also arranged such that the discharge opening 24 is formed on the side face of the developer vessel 16 orthogonal to the axis direction of the stirring roller 18. In the above provision, the tilt sensor 65 is provided in such a way that the direction of a line connecting the inclined faces 66a and 66b are set orthogonal to the side face whereon the discharge opening 24 is formed as in the case of the previous embodiment. Furthermore, irrespectively of the position where the discharge opening 24 is formed, another tilt sensor may be provided in such a way that for example, two inclined faces are connected horizontally at a right angle with respect to a C-D direction.

In the above preferred embodiment, when the tilt sensor 65 detects that the developing device is tilted over the predetermined level, the tilt alarm lamp 69 is set ON. However, it is not limited to the above arrangement. For example, it may be arranged so as to stop the operation of the copying machine by the control device 70. In this case, the control device 70 serves both as the warning means and the control means.

Figure 23:
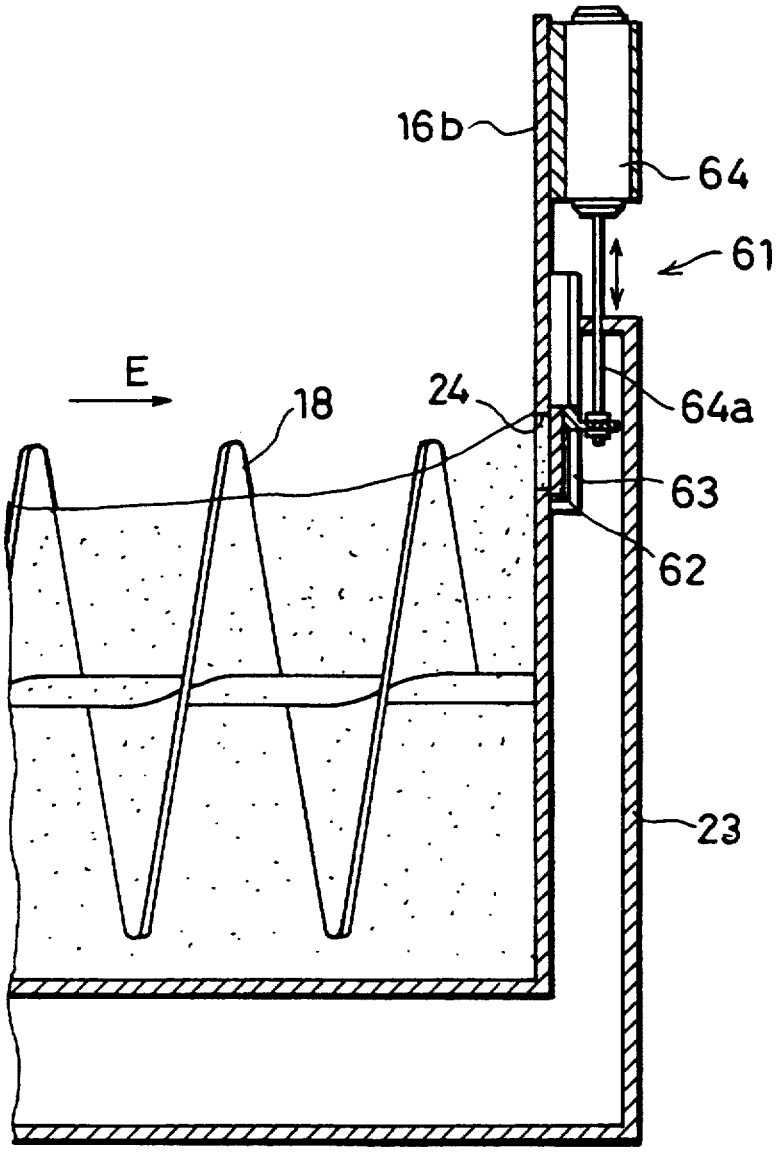
FIG. 23 is a longitudinal cross-sectional view showing an essential part of the developing device showing another arrangement of the control device for controlling the discharge opening to be opened and closed.

Instead of detecting by the tilt sensor 65, the discharge of the developer material from the developer vessel 16 as the developing device 60 being tilted can be prevented by closing the opening and closing plate 62. For example, as shown in FIG. 23, in the case where the discharge opening 24 is formed on the side face **16*b* of the developer vessel 16 on one end side of the axis of the stirring roller 18 in the direction where the developer material is moved by the stirring roller 18 (in the direction of E in the figure), it may be arranged such that the control device 70 controls the opening/closing use solenoid 64 in such a manner that as the stirring roller 18 rotates, the discharge opening 24 is opened; on the other hand, as the rotation of the stirring roller 18 stops, the discharge opening 24 is closed. In the above arrangement, when moving the copying machine, the stirring roller 18 is set in a stop state, and thus the discharge opening 24 is closed by the opening and closing plate 62. Therefore, while the copying machine is being moved or after the copying machine has been moved, even if the developer vessel 16 is tilted, the discharge of the developer material through the discharge opening 24** is surely prevented.

A still another embodiment of the present invention will be described below with reference to FIG. 24 through FIG. 28. For convenience, the same reference numerals indicate the same components as those of the previous embodiments, and therefore the descriptions thereof shall be omitted here.

Figure 24:
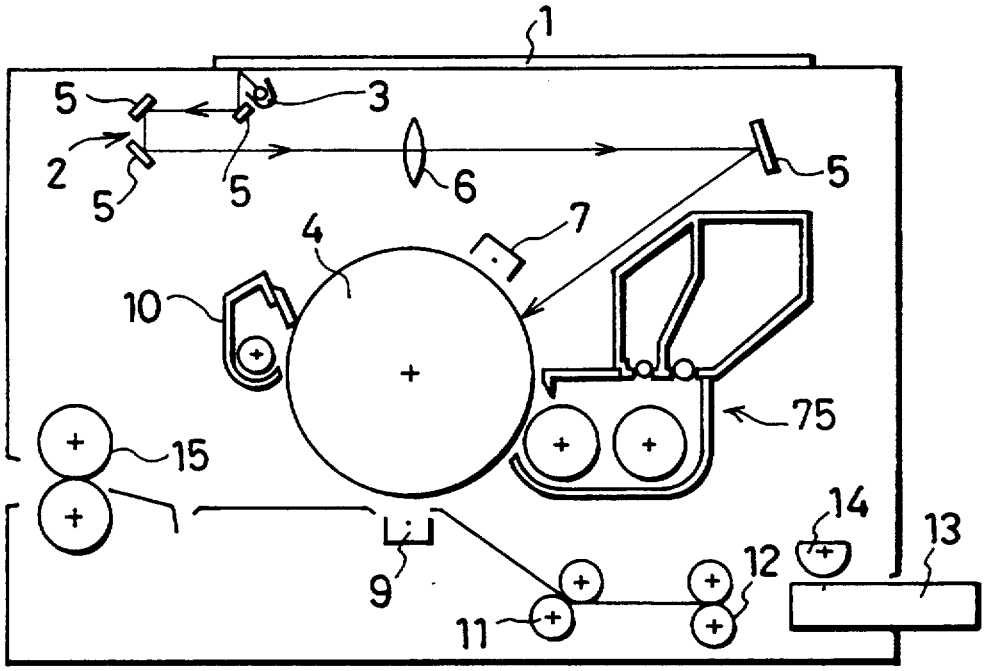
FIG. 24 is an explanatory view showing an entire configuration of a copying machine in accordance with another embodiment of the present invention.
Figure 25:
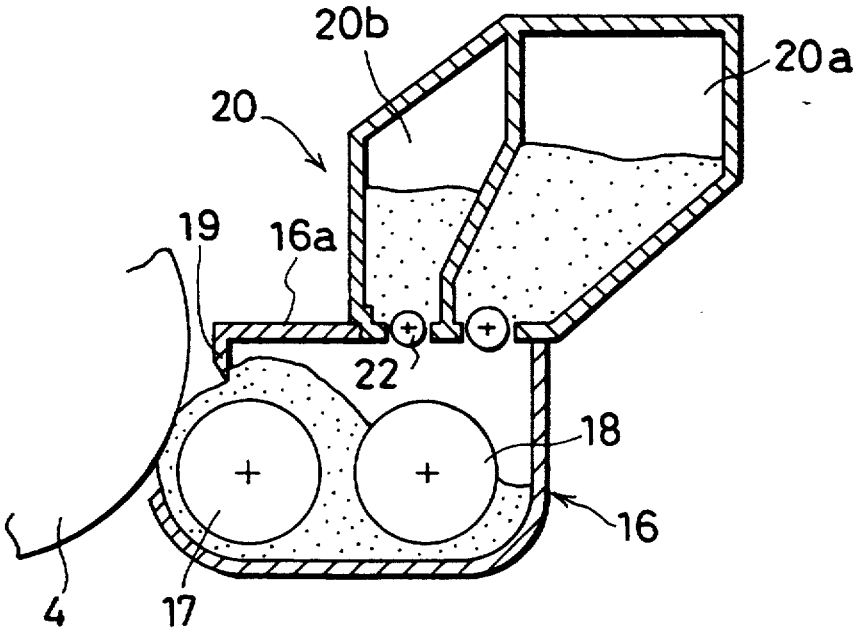
FIG. 25 is a longitudinal cross-sectional view showing a developing device provided in the copying machine of FIG. 24.
Figure 26:
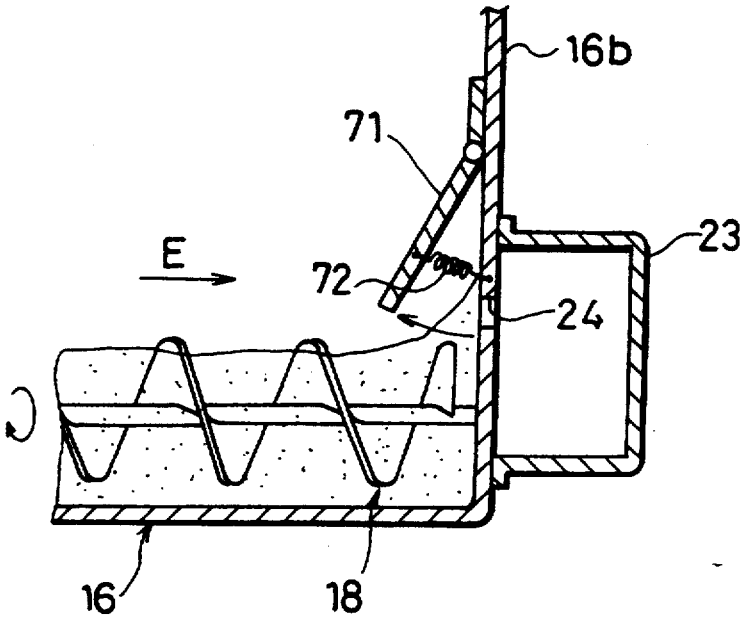
FIG. 26 is a longitudinal cross-sectional view showing essential parts of the developing device in the case where the developing device is placed horizontally.

A developing device 75 of the present embodiment is provided in a copying machine shown in FIG. 24. The structure of the developing device 75 is as shown in FIG. 25 and FIG. 26. As shown in FIG. 26, a discharge opening 24 is formed on a side face **16*b* of the developer vessel 16 on one end side of a stirring roller 18 (stirring means) in the direction where the developer material is carried by the stirring roller 18 (in the direction of E). Furthermore, an opening and closing plate 71 is provided on the side face 16*b* so as to open and close the discharge opening 24. The opening and closing plate 71 is provided in an inner face of the side face 16*b* so that it can freely swing. Using the swinging movement of the opening and closing plate 71, the discharge opening 24 is opened and closed. When the developer vessel 16 is not tilted, the opening and closing plate 71 is placed at such a position that the discharge opening 24 is held open by means of a spring 72 (pressing means). The spring is provided between the opening and closing plate 71 and the side face 16*b*. Additionally, in the present embodiment, the developer vessel 16** is provided so as to be detachable from the developing device, if foreseen, for repairing or checking, etc.

Figure 27:
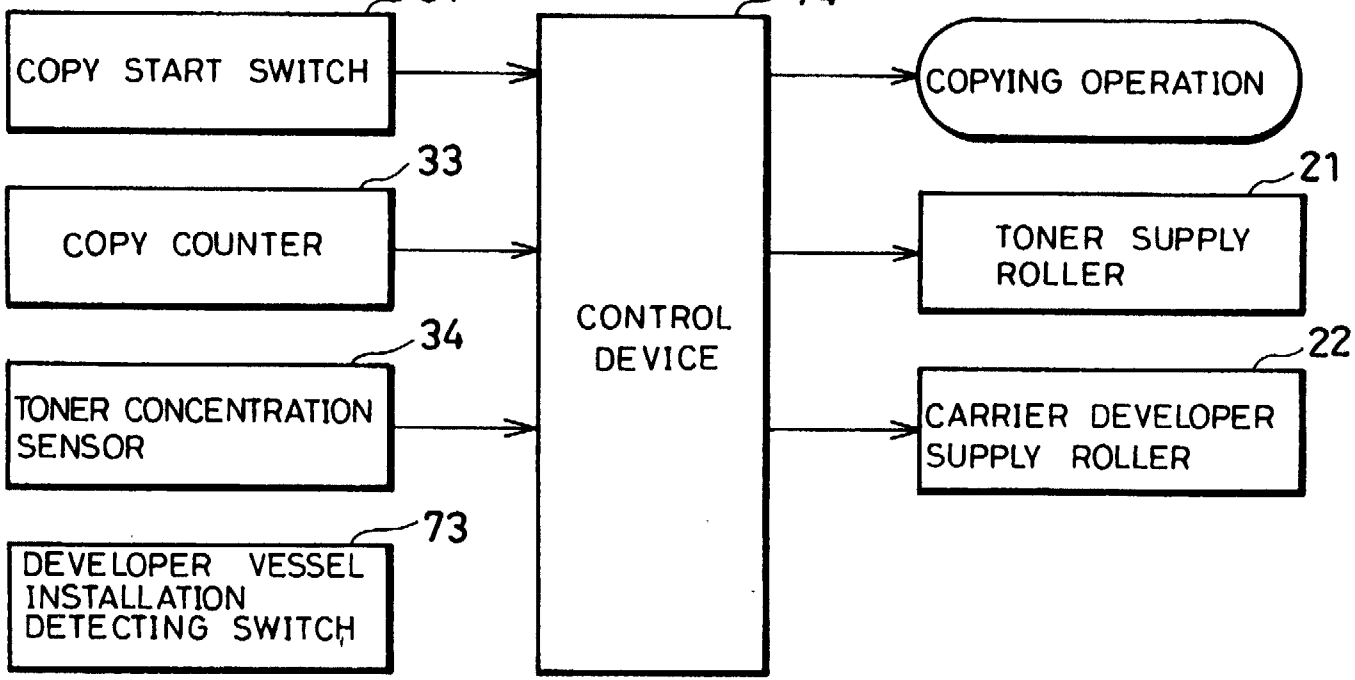
FIG. 27 is a block diagram of a control device in the copying machine.
Figure 28:
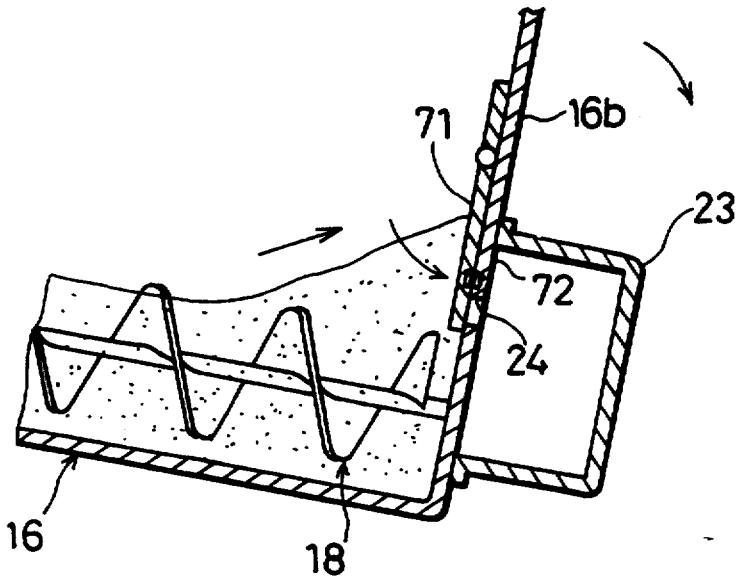
FIG. 28 is a longitudinal cross-sectional view showing essential parts of the developing device in the case where the developing device is tilted from the horizontal position shown in FIG. 26.

A control device 74 shown in FIG. 27 controls a toner supply roller 21 and a carrier developer supply roller 22 based on data from a toner concentration sensor 34 and a copy counter 33 as in the same manner as the previous embodiment. As shown in FIG. 27, a developer vessel installation detecting switch 73 is provided in the developing device 75 for detecting the state of the developer vessel 16 installed at a predetermined position. Only when the installed state of the developer vessel 16 is detected by the developer vessel installation detecting switch 73, the control device 74 activates the toner supply roller 21 or the carrier developer supply roller 22 in response to a supply signal for requesting the supply of the carrier developer and toner particles.

With the above control, the problem that the toner particles or the carrier developer is supplied when the developer vessel 16 is not installed in a predetermined position can be prevented. Furthermore, the control device 74 controls such that the copying operation by operating the copy start switch 31 is set in a wait state until the supply of the carrier developer by rotating the carrier developer supply roller 22 is completed. With the above control, the problem that the charging ability of the developer material in the developer vessel 16 changes while a developing process is being carried out which causes the image quality to be lowered can be prevented.

According to the above arrangement, when the developer vessel 16 is maintained horizontal, as shown in FIG. 26, the opening and closing plate 71 is held open by being pressed by the spring 72, and an excessive quantity of the developer material is gradually discharged from the developer vessel 16 through the discharge opening 24 by an overflow. In the present embodiment, since the discharge opening 24 is formed on the transporting side of the developer material by the stirring roller 18, the discharge of the developer material can be carried out easily and surely.

In the case where the copying machine provided with the developing device 75 is moved, or the developer vessel 16 is taken out for repairing or checking, if the developer vessel 16 is tilted over a predetermined level in the direction where the discharge opening 24 is placed at relatively lower position, the developer material in the developer vessel 16 is shifted toward the discharge opening 24 according to the tilt angle of the developer vessel 16, and the shift of the developer material exerts a force against the pressing force of the spring 72, thereby closing the opening and closing plate 71. Although until the opening and closing plate 71 is completely closed, a small quantity of the developer material will be discharged through the discharge opening 24, the discharge of the large quantity of the developer material can be prevented, thereby preventing the developer material from being reduced excessively. As a result, the deterioration of the charging ability of the developer material in the developer vessel 16 will not occur, thereby preventing the image quality from being lowered. Moreover, since a large quantity of the developer material is not required to be supplied for filling up the reduced quantity of the developer material, a consumption of the developer material can be reduced.

While this invention has been disclosed in conjunction with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed is:

1. A developing device comprising a developer vessel for storing therein a developer material composed of toner particles and carrier granules, wherein stirring means for stirring the developer material and a developer roller for supplying the developer material onto a photoreceptor are respectively provided so as to be freely rotatable, a developer material supply section is provided for supplying a carrier developer including carrier granules from above the developer vessel and a discharge opening for discharging therethrough the developer material is formed on a side face of the developer vessel, said developing device further comprising:

tilt detection means for detecting a tilt of the developer vessel; and warning means for sending out a warning when said tilt detection means detects that the tilt of the developer vessel exceeds a predetermined level.

2. The developing device .as set forth in claim 1, wherein said warning means includes an alarm lamp to be lighted when said warning means detects that the tilt of the developer vessel exceeds the predetermined level.

3. The developing device as set forth in claim 1, wherein said warning means includes a device for giving a warning sound when said warning means detects that the tilt of the developer vessel exceeds a predetermined level.

4. The developing device as set forth in claim 1, wherein said tilt detection means includes:

developing device weight measuring means for measuring a weight of said developing device;

developer material weight computing means for computing a weight of the developer material in the developer vessel based on a measured weight of said developing device;

developer material weight memory means for storing therein a computed weight of the developer material;

developer material weight difference computing means for computing a difference between a weight of the developer material computed by said developer material weight computing means and a weight of the developer material most currently stored in said developer material weight memory means; and control means which determines that the developer vessel is tilted when a computed difference in weight of the developer material exceeds a predetermined level.

5. The developing device as set forth in claim 4, wherein said weight measuring means is provided under the developer vessel and includes a weight measuring plate connected to the developer vessel by means-of an elastic material.

6. The developing device as set forth in claim 4, wherein said developer material weight computing means includes a developer material weight computing section which computes the weight of the developer material in the developer vessel by subtracting a tare weight of the developer vessel, a tare weight of the developer material supply section and a weight of the toner particles remaining in the developer material supply section from the weight of said developing device.

7. The developing device as set forth in claim 6, wherein the tare weight of the developer vessel and the tare weight of the developer material supply section are stored beforehand in a memory provided in said developing device.

8. The developing device as set forth in claim 4, wherein said developer material weight difference computing means includes a developer material weight computing section which computes a difference in weight of the developer material by subtracting a weight of the developer material computed by said developer material weight computing means from a weight of the developer material most currently stored in said developer material weight memory means.

9. The developing device as set forth in claim 1 further comprising a developer material collecting case for collecting therein the developer material discharged through the discharge opening, wherein said tilt detection means includes:

collecting case weight measuring means for measuring a weight of said developer material collecting case;

collecting case weight memory means for storing therein a measured weight of said developer material collecting case; and collecting case weight difference computing means for computing a difference between a weight of said developer material collecting case measured by said collecting case weight measuring means and a weight of said developer material collecting case most currently stored in said collecting case weight memory means, and a control device which determines that said developing device is tilted when the computed difference in weight of the developer material collecting case exceeds a predetermined level is provided.

10. The developing device as set forth in claim 9, wherein said collecting case weight measuring means includes a collecting case weight measuring plate provided under said developer material collecting case, said collecting case weight measuring plate being connected to said developer material collecting case by means of an elastic member.

11. The developing device as set forth in claim 9, wherein said collecting case weight difference computing means includes a collecting case weight difference computing section which computes a difference in weight of said developer material collecting case by subtracting a weight of said developer material collecting case measured by said collecting case weight measuring means from a weight of the developer material weight collecting case most currently stored in said collecting case weight memory means.

12. The developing device as set forth in claim 1, wherein said tilt detection means includes:

height detection means for detecting a height of the developer material in the developer vessel;

developer material height memory means for storing therein a detected height of the developer material; and height difference computing means for computing a difference in height of the developer material between a height of the developer material detected by said height detection means and a height of the developer material most currently stored in said developer material height memory means, and a control device which determines that said developing device is tilted when a computed difference in the height of the developer material exceeds a predetermined level is provided.

13. The developing device as set forth in claim 12, wherein said height detection means includes a plurality of optical sensors provided on the side face of the developer vessel in a height direction with a predetermined interval.

14. The developing device as set forth in claim 12, wherein said height difference computing means includes a height difference computing section which computes a difference in height of the developer material by subtracting a height of the developer material measured by said height detecting means from a height of the developer material most currently stored in said developer material height memory means.

15. The developing device as set forth in claim 1, further comprising:

an opening and closing plate which is mobile between a position where the discharge opening is opened and a position where the discharge opening is closed;

drive means for driving said opening and closing plate to a position where the discharge opening is opened and a position where the discharge opening is closed; and control means which controls said drive means so as to activate said warning means and close said opening and closing plate when said tilt detection means detects that the tilt of the developer vessel exceeds the predetermined level.

16. The developing device as set forth in claim 15, wherein, said detection means includes a tilt sensor including:

a frame made of an insulating material provided therein a bottom section including inclined faces which form a V-shape with a bottom;

an electrically conductive ball provided so as to be freely mobile within said frame by rotating; and two pairs of contact terminals provided so that one pair is provided for each side face, and when said electrically conductive ball comes in contact with the pair of said contact terminals, it is short-circuited.

17. The developing device as set forth in claim 16, wherein:

said tilt sensor is provided in such a way that said electrically conductive ball rotates in a direction orthogonal to the side face of the developer vessel, on which the discharge opening is formed;

said inclined faces which form a V-shape are composed of a first inclined face provided on a side of the discharge opening and a second inclined face provided on the other side; and said first inclined face and said second inclined face are inclined respectively at a tilt angle $\beta$ and a tilt angle $\alpha$ to a horizontal face, said $\alpha$ and $\beta$ satisfying $\alpha \geqq \beta$.

18. A developing device comprising a developer vessel for storing therein a developer material composed of toner particles and carrier granules, wherein stirring means for stirring the developer material and a developer roller for supplying the developer material onto a photoreceptor are respectively provided so as to be freely rotatable, a developer material supply section is provided for supplying a carrier developer including carrier granules from above the developer vessel and a discharge opening for discharging therethrough the developer material is formed on a side face of the developer vessel, said developing device further comprising:

an opening and closing plate which is mobile between a position where the discharge opening is opened and a position where the discharge opening is closed;

drive means for driving said opening and closing plate to a position where the discharge opening is opened and a position where the discharge opening is closed; and control means for controlling said drive means in such a way that said opening and closing plate is opened while said stirring means is being activated; whereas, it is closed while said stirring means is stopped activating.

19. A developing device comprising a developer vessel for storing therein a developer material composed of toner particles and carrier granules, wherein stirring means for stirring the developer material and a developer roller for supplying the developer material onto a photoreceptor are respectively provided so as to be freely rotatable, a developer material supply section is provided for supplying a carrier developer including carrier granules from above the developer vessel and a discharge opening for discharging therethrough the developer material is formed on a side face of the developer vessel, said developing device further comprising:

an opening and closing plate provided on an inner surface side of the side face of the developer vessel, said opening and closing plate being mobile between a position where the discharge opening is opened and a position where the discharge opening is closed in a direction orthogonal to the side face on which the discharge opening is formed;

pressing means connected to said opening and closing plate and to the side face of the developer vessel, wherein said opening and closing plate is held open by said pressing means, and when the developer material is moved towards the discharge opening as the developer vessel is tilted, said opening and closing plate is closed by a weight of the developer material.

20. The developing device as set forth in claim 19, wherein said pressing means is a spring.

* * * * *